US012350547B2

(12) United States Patent
Dalebout et al.

(10) Patent No.: US 12,350,547 B2
(45) Date of Patent: Jul. 8, 2025

(54) DEVICES, SYSTEMS, AND METHODS FOR MOVING A MOVABLE STEP THROUGH A TRANSITION ZONE

(71) Applicant: iFIT Inc., Logan, UT (US)

(72) Inventors: William T. Dalebout, North Logan, UT (US); Gordon Cutler, Providence, UT (US); Trevor Smith, Logan, UT (US)

(73) Assignee: iFIT Inc., Logan, UT (US)

( * ) Notice: Subject to any disclaimer, the term of this patent is extended or adjusted under 35 U.S.C. 154(b) by 327 days.

(21) Appl. No.: 18/114,758

(22) Filed: Feb. 27, 2023

(65) Prior Publication Data

US 2023/0271056 A1 Aug. 31, 2023

Related U.S. Application Data

(60) Provisional application No. 63/314,864, filed on Feb. 28, 2022.

(51) Int. Cl.
*A63B 22/04* (2006.01)
*A63B 21/005* (2006.01)

(52) U.S. Cl.
CPC ..... *A63B 22/04* (2013.01); *A63B 21/0058* (2013.01)

(58) Field of Classification Search
CPC ..... A63B 22/04; A63B 21/0058
See application file for complete search history.

(56) References Cited

U.S. PATENT DOCUMENTS

| | | | | |
|---|---|---|---|---|
| 3,123,646 | A | 3/1964 | Easton | |
| 3,579,339 | A | 5/1971 | Chang et al. | |
| 4,023,795 | A | 5/1977 | Pauls | |
| 4,300,760 | A | 11/1981 | Bobroff | |
| D286,311 | S | 10/1986 | Martinell et al. | |
| 4,681,318 | A | 7/1987 | Lay | |
| 4,684,126 | A | 8/1987 | Dalebout et al. | |
| 4,726,581 | A * | 2/1988 | Chang | A63B 22/04 482/53 |
| 4,728,102 | A | 3/1988 | Pauls | |
| 4,750,736 | A | 6/1988 | Watterson | |
| 4,796,881 | A | 1/1989 | Watterson | |
| 4,813,667 | A | 3/1989 | Watterson | |
| 4,830,371 | A | 5/1989 | Lay | |
| 4,844,451 | A | 7/1989 | Bersonnet et al. | |
| 4,850,585 | A | 7/1989 | Dalebout et al. | |
| D304,849 | S | 11/1989 | Watterson | |
| 4,880,225 | A | 11/1989 | Lucas et al. | |
| 4,883,272 | A | 11/1989 | Lay | |
| D306,468 | S | 3/1990 | Watterson | |

(Continued)

OTHER PUBLICATIONS

U.S. Appl. No. 17/066,485, filed Oct. 9, 2020, Weston et al.

(Continued)

*Primary Examiner* — Megan Anderson
(74) *Attorney, Agent, or Firm* — Holland & Hart LLP

(57) ABSTRACT

A step path for an exercise device includes a support zone, a return zone, and a transition zone between the support zone and the return zone. In the support zone, a front end of a movable step is supported by a front track guide and a rear end of the movable step is supported by a rear track guide. A transition element supports the rear end of the step between the rear guide track and a base guide track, thereby lowering the step-up height of the exercise device.

20 Claims, 9 Drawing Sheets

(56) References Cited

U.S. PATENT DOCUMENTS

D306,891 S 3/1990 Watterson
4,913,396 A 4/1990 Dalebout et al.
D307,614 S 5/1990 Bingham et al.
D307,615 S 5/1990 Bingham et al.
4,921,242 A 5/1990 Watterson
4,932,650 A 6/1990 Bingham et al.
D309,167 S 7/1990 Griffin
D309,485 S 7/1990 Bingham et al.
4,938,478 A 7/1990 Lay
D310,253 S 8/1990 Bersonnet et al.
4,955,599 A 9/1990 Bersonnet et al.
4,971,316 A 11/1990 Dalebout et al.
D313,055 S 12/1990 Watterson
4,974,832 A 12/1990 Dalebout
4,979,737 A 12/1990 Kock
4,981,294 A 1/1991 Dalebout et al.
D315,765 S 3/1991 Measom et al.
4,998,725 A 3/1991 Watterson et al.
5,000,442 A 3/1991 Dalebout et al.
5,000,443 A 3/1991 Dalebout et al.
5,000,444 A 3/1991 Dalebout et al.
D316,124 S 4/1991 Dalebout et al.
5,013,033 A 5/1991 Watterson et al.
5,014,980 A 5/1991 Bersonnet et al.
5,016,871 A 5/1991 Dalebout et al.
D318,085 S 7/1991 Jacobson et al.
D318,086 S 7/1991 Bingham et al.
D318,699 S 7/1991 Jacobson et al.
5,029,801 A 7/1991 Dalebout et al.
5,034,576 A 7/1991 Dalebout et al.
5,058,881 A 10/1991 Measom
5,058,882 A 10/1991 Dalebout et al.
D321,388 S 11/1991 Dalebout
5,062,626 A 11/1991 Dalebout et al.
5,062,627 A 11/1991 Bingham
5,062,632 A 11/1991 Dalebout et al.
5,062,633 A 11/1991 Engel et al.
5,067,710 A 11/1991 Watterson et al.
5,072,929 A 12/1991 Peterson et al.
D323,009 S 1/1992 Dalebout et al.
D323,198 S 1/1992 Dalebout et al.
D323,199 S 1/1992 Dalebout et al.
D323,863 S 2/1992 Watterson
5,088,729 A 2/1992 Dalebout
5,090,694 A 2/1992 Pauls et al.
5,102,380 A 4/1992 Jacobson et al.
5,104,120 A 4/1992 Watterson et al.
5,108,093 A 4/1992 Watterson
D326,491 S 5/1992 Dalebout
5,122,105 A 6/1992 Engel et al.
5,135,216 A 8/1992 Bingham et al.
5,147,265 A 9/1992 Pauls et al.
5,149,084 A 9/1992 Dalebout et al.
5,149,312 A 9/1992 Croft et al.
5,171,196 A 12/1992 Lynch
D332,347 S 1/1993 Raadt et al.
5,190,505 A 3/1993 Dalebout et al.
5,192,255 A 3/1993 Dalebout et al.
5,195,937 A 3/1993 Engel et al.
5,203,826 A 4/1993 Dalebout
D335,511 S 5/1993 Engel et al.
D335,905 S 5/1993 Cutter et al.
D336,498 S 6/1993 Engel et al.
5,217,487 A 6/1993 Engel et al.
D337,361 S 7/1993 Engel et al.
D337,666 S 7/1993 Peterson et al.
D337,799 S 7/1993 Cutter et al.
5,226,866 A 7/1993 Engel et al.
5,244,446 A 9/1993 Engel et al.
5,247,853 A 9/1993 Dalebout
5,259,611 A 11/1993 Dalebout et al.
D342,106 S 12/1993 Campbell et al.
5,279,528 A 1/1994 Dalebout et al.
D344,112 S 2/1994 Smith
D344,557 S 2/1994 Ashby
5,282,776 A 2/1994 Dalebout
5,295,931 A 3/1994 Dreibelbis et al.
5,302,161 A 4/1994 Loubert et al.
D347,251 S 5/1994 Dreibelbis et al.
5,316,534 A 5/1994 Dalebout et al.
D348,493 S 7/1994 Ashby
D348,494 S 7/1994 Ashby
5,328,164 A 7/1994 Soga
5,328,420 A * 7/1994 Allen ..... A63B 22/0023 482/52
D349,931 S 8/1994 Bostic et al.
5,336,142 A 8/1994 Dalebout et al.
5,344,376 A 9/1994 Bostic et al.
D351,202 S 10/1994 Bingham
D351,435 S 10/1994 Peterson et al.
D351,633 S 10/1994 Bingham
D352,534 S 11/1994 Dreibelbis et al.
D353,422 S 12/1994 Bostic et al.
5,372,559 A 12/1994 Dalebout et al.
5,374,228 A 12/1994 Buisman et al.
5,382,221 A 1/1995 Hsu et al.
5,387,168 A 2/1995 Bostic
5,393,690 A 2/1995 Fu et al.
D356,128 S 3/1995 Smith et al.
5,409,435 A 4/1995 Daniels
5,429,563 A 7/1995 Engel et al.
5,431,612 A 7/1995 Holden
D360,915 S 8/1995 Bostic et al.
5,468,205 A 11/1995 McFall et al.
5,489,249 A 2/1996 Brewer et al.
5,492,517 A 2/1996 Bostic et al.
D367,689 S 3/1996 Wilkinson et al.
5,511,740 A 4/1996 Loubert et al.
5,512,025 A 4/1996 Dalebout et al.
D370,949 S 6/1996 Furner
D371,176 S 6/1996 Furner
5,527,245 A 6/1996 Dalebout et al.
5,529,553 A 6/1996 Finlayson
5,540,429 A 7/1996 Dalebout et al.
5,549,533 A 8/1996 Olson et al.
5,554,085 A 9/1996 Dalebout
5,569,128 A 10/1996 Dalebout
5,591,105 A 1/1997 Dalebout et al.
5,591,106 A 1/1997 Dalebout et al.
5,595,556 A 1/1997 Dalebout et al.
5,607,375 A 3/1997 Dalebout et al.
5,611,539 A 3/1997 Watterson et al.
5,622,527 A 4/1997 Watterson et al.
5,626,538 A 5/1997 Dalebout et al.
5,626,542 A 5/1997 Dalebout et al.
D380,024 S 6/1997 Novak et al.
5,637,059 A 6/1997 Dalebout
D380,509 S 7/1997 Wilkinson et al.
5,643,153 A 7/1997 Nylen et al.
5,645,509 A 7/1997 Brewer et al.
D384,118 S 9/1997 Deblauw
5,662,557 A 9/1997 Watterson et al.
5,669,857 A 9/1997 Watterson et al.
5,672,140 A 9/1997 Watterson et al.
5,674,156 A 10/1997 Watterson et al.
5,674,453 A 10/1997 Watterson et al.
5,676,624 A 10/1997 Watterson et al.
5,683,331 A 11/1997 Dalebout
5,683,332 A 11/1997 Watterson et al.
D387,825 S 12/1997 Fleck et al.
5,695,433 A 12/1997 Buisman
5,695,434 A 12/1997 Dalebout et al.
5,695,435 A 12/1997 Dalebout et al.
5,702,325 A 12/1997 Watterson et al.
5,704,879 A 1/1998 Watterson et al.
5,718,657 A 2/1998 Dalebout et al.
5,720,200 A 2/1998 Anderson et al.
5,720,698 A 2/1998 Dalebout et al.
D392,006 S 3/1998 Dalebout et al.
5,722,922 A 3/1998 Watterson et al.
5,733,229 A 3/1998 Dalebout et al.
5,743,833 A 4/1998 Watterson et al.
5,762,584 A 6/1998 Daniels
5,762,587 A 6/1998 Dalebout et al.

(56) References Cited

U.S. PATENT DOCUMENTS 5,769,759 A * 6/1998 Alter ..... A63B 22/04 482/37
5,772,560 A 6/1998 Watterson et al.
5,810,698 A 9/1998 Hullett et al.
5,827,155 A 10/1998 Jensen et al.
5,830,114 A 11/1998 Halfen et al.
5,860,893 A 1/1999 Watterson et al.
5,860,894 A 1/1999 Dalebout et al.
5,899,834 A 5/1999 Dalebout et al.
D412,953 S 8/1999 Armstrong
D413,948 S 9/1999 Dalebout
5,951,441 A 9/1999 Dalebout et al.
5,951,448 A 9/1999 Bolland
D416,596 S 11/1999 Armstrong
6,003,166 A 12/1999 Hald et al.
6,019,710 A 2/2000 Dalebout et al.
6,027,429 A 2/2000 Daniels
6,033,347 A 3/2000 Dalebout et al.
D425,940 S 5/2000 Halfen et al.
6,059,692 A 5/2000 Hickman
D428,949 S 8/2000 Simonson
6,123,646 A 9/2000 Colassi
6,171,217 B1 1/2001 Cutler
6,171,219 B1 1/2001 Simonson
6,174,267 B1 1/2001 Dalebout et al.
6,193,631 B1 2/2001 Hickman
6,228,003 B1 5/2001 Hald et al.
6,238,323 B1 5/2001 Simonson
6,251,052 B1 6/2001 Simonson
6,261,022 B1 7/2001 Dalebout et al.
6,280,362 B1 8/2001 Dalebout et al.
6,296,594 B1 10/2001 Simonson
D450,872 S 11/2001 Dalebout et al.
6,312,363 B1 11/2001 Watterson et al.
D452,338 S 12/2001 Dalebout et al.
D453,543 S 2/2002 Cutler
D453,948 S 2/2002 Cutler
6,350,218 B1 2/2002 Dalebout et al.
6,387,020 B1 5/2002 Simonson
6,413,191 B1 7/2002 Harris et al.
6,422,980 B1 7/2002 Simonson
6,447,424 B1 9/2002 Ashby et al.
6,458,060 B1 10/2002 Watterson et al.
6,458,061 B2 10/2002 Simonson
6,471,622 B1 10/2002 Hammer et al.
6,563,225 B2 5/2003 Soga et al.
6,601,016 B1 7/2003 Brown et al.
6,623,140 B2 9/2003 Watterson et al.
6,626,799 B2 9/2003 Watterson et al.
6,652,424 B2 11/2003 Dalebout
6,685,607 B1 2/2004 Olson
6,695,581 B2 2/2004 Wasson et al.
6,701,271 B2 3/2004 Willner et al.
6,702,719 B1 3/2004 Brown et al.
6,712,740 B2 3/2004 Simonson
6,730,002 B2 5/2004 Hald et al.
6,743,153 B2 6/2004 Watterson et al.
6,746,371 B1 6/2004 Brown et al.
6,749,537 B1 6/2004 Hickman
6,761,667 B1 7/2004 Cutler et al.
6,770,015 B2 8/2004 Simonson
6,786,852 B2 9/2004 Watterson et al.
6,808,472 B1 10/2004 Hickman
6,821,230 B2 11/2004 Dalebout et al.
6,830,540 B2 12/2004 Watterson et al.
6,863,641 B1 3/2005 Brown et al.
6,866,613 B1 3/2005 Brown et al.
6,875,160 B2 4/2005 Watterson et al.
D507,311 S 7/2005 Butler et al.
6,918,858 B2 7/2005 Watterson et al.
6,921,351 B1 7/2005 Hickman et al.
6,974,404 B1 12/2005 Watterson et al.
6,997,852 B2 2/2006 Watterson et al.
7,025,713 B2 4/2006 Dalebout et al.
D520,085 S 5/2006 Willardson et al.
7,044,897 B2 5/2006 Myers et al.
7,052,442 B2 5/2006 Watterson et al.
7,060,006 B1 6/2006 Watterson et al.
7,060,008 B2 6/2006 Watterson et al.
7,070,539 B2 7/2006 Brown et al.
7,097,588 B2 8/2006 Watterson et al.
D527,776 S 9/2006 Willardson et al.
7,112,168 B2 9/2006 Dalebout et al.
7,128,693 B2 10/2006 Brown et al.
7,166,062 B1 1/2007 Watterson et al.
7,166,064 B2 1/2007 Watterson et al.
7,169,087 B2 1/2007 Ercanbrack et al.
7,169,093 B2 1/2007 Simonson et al.
7,192,388 B2 3/2007 Dalebout et al.
7,250,022 B2 7/2007 Dalebout et al.
7,282,016 B2 10/2007 Simonson
7,285,075 B2 10/2007 Cutler et al.
7,344,481 B2 3/2008 Watterson et al.
7,377,882 B2 5/2008 Watterson et al.
7,425,188 B2 9/2008 Ercanbrack et al.
7,429,236 B2 9/2008 Dalebout et al.
7,455,622 B2 11/2008 Watterson et al.
7,482,050 B2 1/2009 Olson
D588,655 S 3/2009 Utykanski
7,510,509 B2 3/2009 Hickman
7,537,546 B2 5/2009 Watterson et al.
7,537,549 B2 5/2009 Nelson et al.
7,537,552 B2 5/2009 Dalebout et al.
7,540,828 B2 6/2009 Watterson et al.
7,549,947 B2 6/2009 Hickman et al.
7,556,590 B2 7/2009 Watterson et al.
7,563,203 B2 7/2009 Dalebout et al.
7,575,536 B1 8/2009 Hickman
7,601,105 B1 10/2009 Gipson et al.
7,604,573 B2 10/2009 Dalebout et al.
D604,373 S 11/2009 Dalebout et al.
7,618,350 B2 11/2009 Dalebout et al.
7,618,357 B2 11/2009 Dalebout et al.
7,625,315 B2 12/2009 Hickman
7,625,321 B2 12/2009 Simonson et al.
7,628,730 B1 12/2009 Watterson et al.
7,628,737 B2 12/2009 Kowallis et al.
7,637,847 B1 12/2009 Hickman
7,645,212 B2 1/2010 Ashby et al.
7,645,213 B2 1/2010 Watterson et al.
7,658,698 B2 2/2010 Pacheco et al.
7,674,205 B2 3/2010 Dalebout et al.
7,713,171 B1 5/2010 Hickman
7,713,172 B2 5/2010 Watterson et al.
7,713,180 B2 5/2010 Wickens et al.
7,717,828 B2 5/2010 Simonson et al.
7,736,279 B2 6/2010 Dalebout et al.
7,740,563 B2 6/2010 Dalebout et al.
7,749,144 B2 7/2010 Hammer
7,766,797 B2 8/2010 Dalebout et al.
7,771,329 B2 8/2010 Dalebout et al.
7,775,940 B2 8/2010 Dalebout et al.
7,789,800 B1 9/2010 Watterson et al.
7,798,946 B2 9/2010 Dalebout et al.
7,815,550 B2 10/2010 Watterson et al.
7,857,731 B2 12/2010 Hickman et al.
7,862,475 B2 1/2011 Watterson et al.
7,862,478 B2 1/2011 Watterson et al.
7,862,483 B2 1/2011 Hendrickson et al.
D635,207 S 3/2011 Dalebout et al.
7,901,330 B2 3/2011 Dalebout et al.
7,909,740 B2 3/2011 Dalebout et al.
7,980,996 B2 7/2011 Hickman
7,981,000 B2 7/2011 Watterson et al.
7,985,164 B2 7/2011 Ashby
8,029,415 B2 10/2011 Ashby et al.
8,033,960 B1 10/2011 Dalebout et al.
D650,451 S 12/2011 Olson et al.
D652,877 S 1/2012 Dalebout et al.
8,152,702 B2 4/2012 Pacheco
D659,775 S 5/2012 Olson et al.
D659,777 S 5/2012 Watterson et al.
D660,383 S 5/2012 Watterson et al.
D664,613 S 7/2012 Dalebout et al.

(56) References Cited

U.S. PATENT DOCUMENTS 8,251,874 B2 8/2012 Ashby et al.
8,298,123 B2 10/2012 Hickman
8,298,125 B2 10/2012 Colledge et al.
D671,177 S 11/2012 Sip
D671,178 S 11/2012 Sip
D673,626 S 1/2013 Olson et al.
8,690,735 B2 4/2014 Watterson et al.
D707,763 S 6/2014 Cutler
8,740,753 B2 6/2014 Olson et al.
8,758,201 B2 6/2014 Ashby et al.
8,771,153 B2 7/2014 Dalebout et al.
8,784,270 B2 7/2014 Ashby et al.
8,808,148 B2 8/2014 Watterson et al.
8,814,762 B2 8/2014 Butler et al.
D712,493 S 9/2014 Ercanbrack et al.
8,840,075 B2 9/2014 Dalebout et al.
8,845,493 B2 9/2014 Watterson et al.
8,870,726 B2 10/2014 Watterson et al.
8,876,668 B2 11/2014 Hendrickson et al.
8,894,549 B2 11/2014 Colledge
8,894,555 B2 11/2014 Colledge et al.
8,911,330 B2 12/2014 Watterson et al.
8,920,288 B2 12/2014 Dalebout et al.
8,986,165 B2 3/2015 Ashby
8,992,364 B2 3/2015 Law et al.
8,992,387 B2 3/2015 Watterson et al.
D726,476 S 4/2015 Ercanbrack
9,028,368 B2 5/2015 Ashby et al.
9,028,370 B2 5/2015 Watterson et al.
9,039,578 B2 5/2015 Dalebout
D731,011 S 6/2015 Buchanan
9,072,930 B2 7/2015 Ashby et al.
9,119,983 B2 9/2015 Rhea
9,123,317 B2 9/2015 Watterson et al.
9,126,071 B2 9/2015 Smith
9,126,072 B2 9/2015 Watterson
9,138,615 B2 9/2015 Olson et al.
9,142,139 B2 9/2015 Watterson et al.
9,144,703 B2 9/2015 Dalebout et al.
9,149,683 B2 10/2015 Watterson et al.
9,186,535 B2 11/2015 Ercanbrack
9,186,549 B2 11/2015 Watterson et al.
9,216,317 B2 12/2015 Golden, Jr. et al.
9,254,409 B2 2/2016 Dalebout et al.
9,254,416 B2 2/2016 Ashby
9,278,248 B2 3/2016 Tyger et al.
9,278,249 B2 3/2016 Watterson
9,278,250 B2 3/2016 Buchanan
9,289,648 B2 3/2016 Watterson
9,339,691 B2 5/2016 Brammer
9,352,185 B2 5/2016 Hendrickson et al.
9,352,186 B2 5/2016 Watterson
9,375,605 B2 6/2016 Tyger et al.
9,381,394 B2 7/2016 Mortensen et al.
9,387,387 B2 7/2016 Dalebout
9,393,453 B2 7/2016 Watterson
9,403,047 B2 8/2016 Olson et al.
9,403,051 B2 8/2016 Cutler
9,421,416 B2 8/2016 Mortensen et al.
9,457,219 B2 10/2016 Smith
9,457,220 B2 10/2016 Olson
9,457,222 B2 10/2016 Dalebout
9,460,632 B2 10/2016 Watterson
9,463,356 B2 10/2016 Rhea
9,468,794 B2 10/2016 Barton
9,468,798 B2 10/2016 Dalebout
9,480,874 B2 11/2016 Cutler
9,492,704 B2 11/2016 Mortensen et al.
9,498,668 B2 11/2016 Smith
9,517,378 B2 12/2016 Ashby et al.
9,521,901 B2 12/2016 Dalebout
9,533,187 B2 1/2017 Dalebout
9,539,461 B2 1/2017 Ercanbrack
9,579,544 B2 2/2017 Watterson
9,586,086 B2 3/2017 Dalebout et al.
9,586,090 B2 3/2017 Watterson et al.
9,604,099 B2 3/2017 Taylor
9,616,276 B2 4/2017 Dalebout et al.
9,616,278 B2 4/2017 Olson
9,623,281 B2 4/2017 Hendrickson et al.
9,623,286 B1 4/2017 Chen
9,636,567 B2 5/2017 Brammer et al.
9,675,839 B2 6/2017 Dalebout et al.
9,682,307 B2 6/2017 Dalebout
9,694,234 B2 7/2017 Dalebout et al.
9,694,242 B2 7/2017 Ashby et al.
9,713,737 B2 7/2017 Chen
9,737,755 B2 8/2017 Dalebout
9,757,605 B2 9/2017 Olson et al.
9,764,186 B2 9/2017 Dalebout et al.
9,767,785 B2 9/2017 Ashby et al.
9,795,822 B2 10/2017 Smith et al.
9,808,672 B2 11/2017 Dalebout
9,849,326 B2 12/2017 Smith
9,878,210 B2 1/2018 Watterson
9,889,334 B2 2/2018 Ashby et al.
9,889,339 B2 2/2018 Douglass
9,937,376 B2 4/2018 McInelly et al.
9,937,377 B2 4/2018 McInelly et al.
9,937,378 B2 4/2018 Dalebout et al.
9,937,379 B2 4/2018 Mortensen et al.
9,943,719 B2 4/2018 Smith et al.
9,943,722 B2 4/2018 Dalebout
9,948,037 B2 4/2018 Ashby
9,968,816 B2 5/2018 Olson et al.
9,968,821 B2 5/2018 Finlayson et al.
9,968,823 B2 5/2018 Cutler
9,993,682 B2 * 6/2018 Johnson ..... A63B 21/0052
10,010,755 B2 7/2018 Watterson
10,010,756 B2 7/2018 Watterson
10,029,145 B2 7/2018 Douglass
D826,350 S 8/2018 Hochstrasser
10,046,196 B2 8/2018 Ercanbrack et al.
D827,733 S 9/2018 Hochstrasser
10,065,064 B2 9/2018 Smith et al.
10,071,285 B2 9/2018 Smith et al.
10,085,586 B2 10/2018 Smith et al.
10,086,254 B2 10/2018 Watterson
10,136,842 B2 11/2018 Ashby
10,186,161 B2 1/2019 Watterson
10,188,890 B2 1/2019 Olson et al.
10,207,143 B2 2/2019 Dalebout et al.
10,207,145 B2 2/2019 Tyger et al.
10,207,147 B2 2/2019 Ercanbrack et al.
10,207,148 B2 2/2019 Powell et al.
10,212,994 B2 2/2019 Watterson et al.
10,220,259 B2 3/2019 Brammer
10,226,396 B2 3/2019 Ashby
10,226,664 B2 3/2019 Dalebout et al.
10,252,109 B2 4/2019 Watterson
10,258,828 B2 4/2019 Dalebout et al.
10,272,317 B2 4/2019 Watterson
10,279,212 B2 5/2019 Dalebout et al.
10,293,211 B2 5/2019 Watterson et al.
D852,292 S 6/2019 Cutler
10,343,017 B2 7/2019 Jackson
10,376,736 B2 8/2019 Powell et al.
10,388,183 B2 8/2019 Watterson
10,391,361 B2 8/2019 Watterson
D864,320 S 10/2019 Weston
D864,321 S 10/2019 Weston
10,426,989 B2 10/2019 Dalebout
10,433,612 B2 10/2019 Ashby et al.
10,441,840 B2 10/2019 Dalebout
10,441,844 B2 10/2019 Powell
10,449,416 B2 10/2019 Dalebout et al.
10,471,299 B2 11/2019 Powell
D868,909 S 12/2019 Cutler et al.
10,492,519 B2 12/2019 Capell et al.
10,493,349 B2 12/2019 Watterson
10,500,473 B2 12/2019 Watterson
10,537,764 B2 1/2020 Smith et al.
10,543,395 B2 1/2020 Powell et al.
10,556,148 B2 2/2020 Paulson et al.

(56) References Cited

U.S. PATENT DOCUMENTS

| | | | | |
|---|---|---|---|---|
| 10,561,877 | B2 | 2/2020 | Workman | |
| 10,561,893 | B2 | 2/2020 | Chatterton et al. | |
| 10,561,894 | B2 | 2/2020 | Dalebout et al. | |
| 10,569,121 | B2 | 2/2020 | Watterson | |
| 10,569,123 | B2 | 2/2020 | Hochstrasser et al. | |
| 10,625,114 | B2 | 4/2020 | Ercanbrack | |
| 10,625,137 | B2 | 4/2020 | Dalebout et al. | |
| 10,661,114 | B2 | 5/2020 | Watterson et al. | |
| 10,668,320 | B2 | 6/2020 | Watterson | |
| 10,671,705 | B2 | 6/2020 | Capell et al. | |
| 10,688,346 | B2 | 6/2020 | Brammer | |
| 10,702,736 | B2 | 7/2020 | Weston et al. | |
| 10,709,925 | B2 | 7/2020 | Dalebout et al. | |
| 10,726,730 | B2 | 7/2020 | Watterson | |
| 10,729,965 | B2 | 8/2020 | Powell | |
| 10,758,767 | B2 | 9/2020 | Olson et al. | |
| 10,786,706 | B2 | 9/2020 | Smith | |
| 10,864,407 | B2 | 12/2020 | Watterson et al. | |
| 10,918,905 | B2 | 2/2021 | Powell et al. | |
| 10,932,517 | B2 | 3/2021 | Ashby et al. | |
| 10,940,360 | B2 | 3/2021 | Dalebout et al. | |
| 10,953,268 | B1 | 3/2021 | Dalebout et al. | |
| 10,953,305 | B2 | 3/2021 | Dalebout et al. | |
| 10,967,214 | B1 | 4/2021 | Olson et al. | |
| 10,994,173 | B2 | 5/2021 | Watterson | |
| 11,000,730 | B2 | 5/2021 | Dalebout et al. | |
| 11,013,960 | B2 | 5/2021 | Watterson et al. | |
| 11,033,777 | B1 | 6/2021 | Watterson et al. | |
| 11,058,913 | B2 | 7/2021 | Dalebout et al. | |
| 11,058,914 | B2 | 7/2021 | Powell | |
| 11,058,918 | B1 | 7/2021 | Watterson et al. | |
| 11,187,285 | B2 | 11/2021 | Wrobel | |
| 11,298,577 | B2 | 4/2022 | Watterson | |
| 11,326,673 | B2 | 5/2022 | Buchanan | |
| 11,338,169 | B2 | 5/2022 | Dalebout et al. | |
| 11,338,175 | B2 | 5/2022 | Watterson et al. | |
| 11,426,633 | B2 | 8/2022 | Watterson et al. | |
| 11,451,108 | B2 | 9/2022 | Tinney | |
| 11,452,903 | B2 | 9/2022 | Watterson | |
| 11,511,152 | B2 | 11/2022 | Powell et al. | |
| 11,534,651 | B2 | 12/2022 | Ercanbrack et al. | |
| 11,534,654 | B2 | 12/2022 | Silcock et al. | |
| 11,534,655 | B2 | 12/2022 | Dalebout et al. | |
| 11,565,148 | B2 | 1/2023 | Dalebout et al. | |
| 11,596,830 | B2 | 3/2023 | Dalebout et al. | |
| 11,642,564 | B2 | 5/2023 | Watterson | |
| 11,673,036 | B2 | 6/2023 | Dalebout et al. | |
| 11,680,611 | B2 | 6/2023 | Wrobel | |
| 11,700,905 | B2 | 7/2023 | Ashby et al. | |
| 11,708,874 | B2 | 7/2023 | Wrobel | |
| 2008/0051256 | A1 | 2/2008 | Ashby et al. | |
| 2008/0163571 | A1* | 7/2008 | Kohler | E04F 11/04 248/220.22 |
| 2015/0251055 | A1 | 9/2015 | Ashby | |
| 2016/0058335 | A1 | 3/2016 | Ashby | |
| 2016/0346595 | A1 | 12/2016 | Dalebout et al. | |
| 2017/0124912 | A1 | 5/2017 | Ashby et al. | |
| 2017/0193578 | A1 | 7/2017 | Watterson | |
| 2017/0266489 | A1 | 9/2017 | Douglass et al. | |
| 2017/0270820 | A1 | 9/2017 | Ashby et al. | |
| 2018/0085630 | A1 | 3/2018 | Capell et al. | |
| 2018/0099116 | A1 | 4/2018 | Ashby | |
| 2018/0099180 | A1 | 4/2018 | Wilkinson | |
| 2018/0111034 | A1 | 4/2018 | Watterson | |
| 2019/0022455 | A1 | 1/2019 | Kueker et al. | |
| 2019/0223612 | A1 | 7/2019 | Watterson et al. | |
| 2019/0269971 | A1 | 9/2019 | Capell et al. | |
| 2020/0009417 | A1 | 1/2020 | Dalebout | |
| 2020/0391069 | A1 | 8/2020 | Olson et al. | |
| 2020/0368575 | A1 | 11/2020 | Hays et al. | |
| 2021/0001177 | A1 | 1/2021 | Smith | |
| 2021/0046353 | A1 | 2/2021 | Dalebout et al. | |
| 2021/0106899 | A1 | 4/2021 | Willardson et al. | |
| 2021/0110910 | A1 | 4/2021 | Ostler et al. | |
| 2021/0146221 | A1 | 5/2021 | Dalebout et al. | |
| 2021/0213331 | A1 | 7/2021 | Watterson | |
| 2021/0268336 | A1 | 9/2021 | Watterson et al. | |
| 2021/0291013 | A1 | 9/2021 | Nascimento | |
| 2021/0299518 | A1 | 9/2021 | Brammer et al. | |
| 2021/0299542 | A1 | 9/2021 | Brammer et al. | |
| 2021/0339079 | A1 | 11/2021 | Dalebout et al. | |
| 2022/0062685 | A1 | 3/2022 | Ashby et al. | |
| 2022/0104992 | A1 | 4/2022 | Ashby | |
| 2022/0212052 | A1 | 7/2022 | Ercanbrack et al. | |
| 2022/0241649 | A1 | 8/2022 | Ashby | |
| 2022/0241665 | A1 | 8/2022 | Dalebout et al. | |
| 2022/0241668 | A1 | 8/2022 | Willardson et al. | |
| 2022/0249912 | A1 | 8/2022 | Watterson et al. | |
| 2022/0257994 | A1 | 8/2022 | Smith | |
| 2022/0258007 | A1 | 8/2022 | Watterson et al. | |
| 2022/0258008 | A1 | 8/2022 | Watterson et al. | |
| 2022/0266085 | A1 | 8/2022 | Dalebout et al. | |
| 2022/0280857 | A1 | 9/2022 | Watterson | |
| 2022/0309042 | A1 | 9/2022 | Archer | |
| 2022/0314078 | A1 | 10/2022 | Watterson et al. | |
| 2022/0323827 | A1 | 10/2022 | Watterson et al. | |
| 2022/0339493 | A1 | 10/2022 | Larsen | |
| 2022/0339520 | A1 | 10/2022 | Toth | |
| 2022/0342969 | A1 | 10/2022 | Watterson et al. | |
| 2022/0347516 | A1 | 11/2022 | Taylor | |
| 2022/0347548 | A1 | 11/2022 | Watterson | |
| 2022/0362613 | A1 | 11/2022 | Watterson et al. | |
| 2022/0362624 | A1 | 11/2022 | Dalebout | |
| 2022/0395729 | A1 | 12/2022 | Toth | |
| 2023/0039903 | A1 | 2/2023 | Brammer et al. | |
| 2023/0054845 | A1 | 2/2023 | Smith | |
| 2023/0122235 | A1 | 4/2023 | Ashby et al. | |
| 2023/0128721 | A1 | 4/2023 | Plummer | |
| 2023/0158358 | A1 | 5/2023 | Ercanbrack et al. | |
| 2023/0181993 | A1 | 6/2023 | Taylor et al. | |
| 2023/0191189 | A1 | 6/2023 | Taylor et al. | |
| 2023/0191197 | A1 | 6/2023 | Ashby | |
| 2023/0218975 | A1 | 7/2023 | Toles et al. | |
| 2023/0226401 | A1 | 7/2023 | Watterson | |

OTHER PUBLICATIONS

U.S. Appl. No. 17/739,819, filed May 9, 2022, Buchanan.
U.S. Appl. No. 17/841,313, filed Jun. 15, 2022, Weston et al.
U.S. Appl. No. 17/963,822, filed Oct. 11, 2022, Powell.
U.S. Appl. No. 18/091,004, filed Dec. 29, 2022, Cox.
U.S. Appl. No. 18/103,221, filed Jan. 30, 2023, Dalebout et al.
U.S. Appl. No. 18/114,758, filed Feb. 27, 2023, Cutler et al.
U.S. Appl. No. 18/117,263, filed Mar. 3, 2023, Smith et al.
U.S. Appl. No. 18/123,026, filed Mar. 17, 2023, Silcock et al.
U.S. Appl. No. 18/132,277, filed Apr. 7, 2023, Vasquez et al.
U.S. Appl. No. 18/136,535, filed Apr. 19, 2023, Ashby et al.
U.S. Appl. No. 18/141,872, filed May 1, 2023, Ashby et al.
U.S. Appl. No. 18/205,299, filed Jun. 2, 2023, Wrobel.
U.S. Appl. No. 18/207,512, filed Jun. 8, 2023, Chuang.
U.S. Appl. No. 18/210,505, filed Jun. 15, 2023, Nielsen et al.
U.S. Appl. No. 29/702,127, filed Sep. 16, 2019, Cutler et al.
U.S. Appl. No. 62/273,852, filed Dec. 31, 2015, Watterson.
U.S. Appl. No. 63/073,081, filed Sep. 1, 2021, Ashby et al.
U.S. Appl. No. 63/079,697, filed Sep. 7, 2020, Willardson et al.
U.S. Appl. No. 63/086,793, filed Oct. 20, 2020, Ashby.
U.S. Appl. No. 63/134,036, filed Jan. 5, 2021, Ercanbrack et al.
U.S. Appl. No. 63/150,066, filed Feb. 16, 2021, Smith.
U.S. Appl. No. 63/156,801, filed Mar. 4, 2021, Watterson.
U.S. Appl. No. 63/165,498, filed Mar. 24, 2021, Archer.
U.S. Appl. No. 63/179,094, filed Apr. 23, 2021, Watterson et al.
U.S. Appl. No. 63/180,521, filed Apr. 27, 2021, Watterson et al.
U.S. Appl. No. 63/187,348, filed May 11, 2021, Dalebout et al.
U.S. Appl. No. 63/188,431, filed May 13, 2021, Plummer.
U.S. Appl. No. 63/200,903, filed Apr. 2, 2021, Watterson et al.
U.S. Appl. No. 63/211,870, filed Jun. 17, 2021, Watterson et al.
U.S. Appl. No. 63/216,313, filed Jun. 29, 2021, Watterson et al.
U.S. Appl. No. 63/229,794, filed Aug. 12, 2021, Brammer.
U.S. Appl. No. 63/235,002, filed Aug. 19, 2021, Smith.
U.S. Appl. No. 63/254,470, filed Oct. 11, 2021, Powell.

(56) References Cited

OTHER PUBLICATIONS

U.S. Appl. No. 63/278,714, filed Nov. 12, 2021, Taylor.
U.S. Appl. No. 63/289,997, filed Dec. 15, 2021, Taylor et al.
U.S. Appl. No. 63/290,455, filed Dec. 16, 2021, Taylor et al.
U.S. Appl. No. 63/290,557, filed Dec. 16, 2021, Ashby.
U.S. Appl. No. 63/298,170, filed Jan. 10, 2022, Ercanbrack et al.
U.S. Appl. No. 63/299,357, filed Jan. 13, 2022, Toles et al..
U.S. Appl. No. 63/305,976, filed Feb. 2, 2022, Watterson.
U.S. Appl. No. 63/329,270, filed Apr. 8, 2022, Vasquez et al.
U.S. Appl. No. 63/332,581, filed Apr. 25, 2022, Ashby et al.
U.S. Appl. No. 63/338,265, filed May 4, 2022, Ashby et al.
U.S. Appl. No. 63/350,072, filed Jun. 8, 2022, Chuang.
U.S. Appl. No. 63/352,539, filed Jun. 15, 2022, Nielsen et al.
U.S. Appl. No. 63/471,680, filed Jun. 7, 2023, Powell et al.
Amazon.com, "StairMaster 10G Gauntlet 10 Series Stepmill with Overdrive Training+15" Touch Screen Console", Originally Accessed From https://www.amazon.com/StairMaster-Gaunlet-Stepmill-Overdrive-Training/dp/B081W4TX1L/ref=sr_1_4?dchild=1&keywords=stepmill&qid=1634323430&s=sporting-goods&sr=1-4, on or around Mar. 15, 2021, 6 pages.
Amazon.com, "StairMaster SM3 StepMill", Retrieved From http://web.archive.org/web/20200926191827/https://www.amazon.com/StairMaster-140001-SM3-StepMill/dp/B00B1W8N0A, with an internet archive date of Sep. 26, 2020, 4 pages.

* cited by examiner

DEVICES, SYSTEMS, AND METHODS FOR MOVING A MOVABLE STEP THROUGH A TRANSITION ZONE

CROSS-REFERENCE TO RELATED APPLICATIONS

This application claims priority to and benefit of U.S. Provisional Patent Application No. 63/314,864, filed Feb. 28, 2022, which is incorporated by reference in its entirety.

BACKGROUND

Exercise is a popular activity to improve one's physical and/or mental health. Many common activities may be used as exercise, such as walking, running, bicycling, lifting weights, climbing stairs, and so forth. In some situations, a user may use an exercise device to simulate an activity. The exercise device may allow the user to perform an exercise activity from a single location, such as a gym, a user's home, office, any other location, and combinations thereof. A treadmill may allow a user to walk, job, or run. A stationary bicycle may allow a user to cycle. A stair machine may allow a user to climb a flight of stairs.

BRIEF SUMMARY

In some embodiments, a movable step includes a platform and a drive mechanism that is movable along a step path. The step path has a support zone, a transition zone, and a return zone. The platform is connected to the drive mechanism and movable along the step path. A front wheel is connected to a front side of the platform and supported by a first guide track when the platform is in the support zone. A rear wheel is connected to a rear side of the platform and supported by a second guide track when the platform is in the support zone. The rear wheel is supported by a third guide track when the platform is in the transition zone. In some embodiments, the movable step is part of a plurality of movable steps of an exercise device.

In other embodiments, a method for operating an exercise device includes rotating a drive element coupled to a movable step through a step path. The step path includes a support zone, a return zone, and a transition zone between the support zone and the return zone. The movable step is moved through the support zone and a front set of wheels are supported by a front guide track and a rear set of wheels are supported by a rear guide track. At the transition zone, the rear set of wheels are guided from the rear guide track to the base guide track using a positioning element. The movable step is moved through the transition zone to the return zone. The rear set of wheels are supported by the base guide track in the transition zone.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific implementations thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example implementations, the implementations will be described and explained with additional specificity and detail through the use of the accompanying drawings in which:

FIG. 3-1 is representation of a top-down view of an exercise device, according to at least one embodiment of the present disclosure;

FIG. 3-2 is a representation of a front view of the exercise device of FIG. 3-1;

FIG. 4-1 through FIG. 4-3 are representations of a transition zone of a step path, according to at least one embodiment of the present disclosure;

DETAILED DESCRIPTION

This disclosure generally relates to devices, systems, and methods for operation of an exercise device. The exercise device includes a plurality of movable steps. The movable steps move around a step path from an upper portion of the exercise device to a lower portion of the exercise device. When the steps reach the lower portion of the exercise device, the steps may loop around and return to the upper portion. The steps follow a step path. In a support zone of the step path, the steps may move from the upper portion to the lower portion. In the support zone, a front set of wheels connected to a front side of the step are supported and roll along a front guide track and a rear set of wheels connected to a rear side of the steps are supported and roll along a rear guide track. At the lower portion of the exercise device, the rear set of wheels may transfer from the rear guide track to a base guide track. This may allow the step to remain parallel to the support surface as it transfers from the step portion to a return zone of the step path. This may help to lower a height from the platform of the step to the support surface.

In accordance with at least one embodiment of the present disclosure, in the transition zone of the step path between the support zone and the return zone, a positioning element may guide the rear set of wheels from the rear guide track to the base guide track. The positioning element may support the rear set of wheels as they leave the rear guide track and contact or engage the base guide track. In some embodiments, the positioning element may include any element, such as a cam, a latch, a magnet, any other positioning element, and combinations thereof.

The step may be moved through the step path by a drive mechanism. The drive mechanism may be connected to the step at a front side of the step. For example, the drive mechanism may include a drive element, such as a chain or a belt. The drive element may be connected to an axle of the front set of wheels. The rear side of the step may be free-floating and not directly connected to the drive element. As the step moves through the return zone of the step path, the rear side of the step and the rear set of wheels may hang below the front side of the step. This may place the step in a vertical position (e.g., parallel to the force of gravity, approximately perpendicular to the support surface).

When the step reaches the upper portion of the exercise device, a positioning wheel may engage the step at a bottom side of the step. The positioning wheel may push the step from the vertical position to the horizontal position when the step transitions from the return zone to the support zone of the step path. In some embodiments, the positioning wheel may engage a runner on the bottom side of the step to position the step in a support position.

Figure 1:
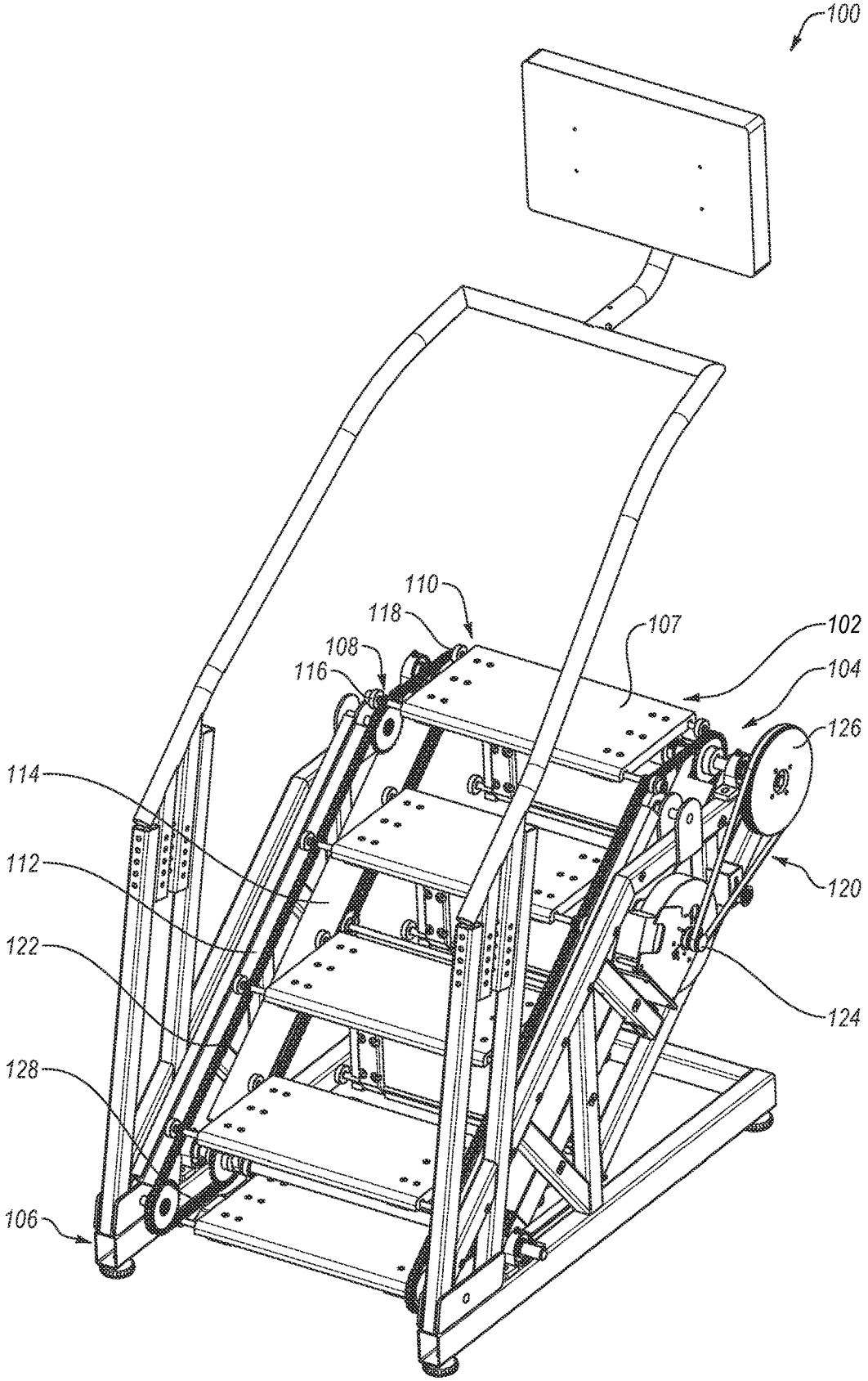
FIG. 1 is a representation of a perspective view of an exercise device, according to at least one embodiment of the present disclosure.

FIG. 1 is a perspective view of an exercise device 100, according to at least one embodiment of the present disclosure. As may be seen, the exercise device 100 may simulate climbing stairs. The exercise device 100 may include a plurality of movable steps 102. The steps 102 may move from an upper portion 104 of the exercise device 100 to a lower portion 106 of the exercise device. As the steps 102 move from the upper portion 104 to the lower portion 106, a user may "climb" stairs by stepping on a platform 107 of successive steps 102 as they are revealed and moved between the upper portion 104 and the lower portion 106. In this manner, the user may perform an exercise activity that simulates climbing a flight of stairs on the exercise device 100.

The steps 102 may have a front end 108 and a rear end 110. As the steps move from the upper portion 104 to the lower portion 106, the front end 108 may be supported by a front guide track 112. The rear end 110 may be supported by a rear guide track 114. In some embodiments, a front set of wheels 116 may be connected to the front end 108 of the step 102 and a rear set of wheels 118 may be connected to the rear end 110 of the step 102. As the step 102 moves from the upper portion 104 to the lower portion 106, the front set of wheels 116 may be supported by and/or roll along the front guide track 112 and the rear set of wheels 118 may be supported by and/or roll along the rear guide track 114. The front guide track 112 and the rear guide track 114 may support the weight of the user as the user steps on the platform 107 of the steps 102. In some embodiments, the front guide track 112 may be parallel to the rear guide track 114.

In some embodiments, a drive mechanism 120 may move the steps 102 along the step path. The drive mechanism 120 may include a drive element 122. The drive element 122 may be connected to the steps 102. In accordance with at least one embodiment of the present disclosure, the drive element 122 may be connected to each step 102 at the front end 108 of the platform 107. As the drive element 122 moves along the step path, the steps 102 may move along the step path as well. In accordance with at least one embodiment of the present disclosure, the drive element 122 may rotate along the step path from the upper portion 104 to the lower portion 106, thereby allowing the user to climb up the steps 102. In some embodiments, the drive element 122 may rotate along the step path from the lower portion 106 to the upper portion 104. This may allow the user to walk or climb down the steps 102.

In some embodiments, the drive mechanism 120 may include a motor 124. The motor 124 may be connected to one or more drive wheels 126. The drive wheels 126 may be connected to or coupled with the drive element 122. In this manner, when the motor 124 rotates the drive wheels 126, the drive wheels 126 may cause the drive element 122 to move. In some embodiments, the drive mechanism 120 may include a flywheel or other energy storage device. The flywheel may help to maintain a smooth rotation or movement of the drive mechanism 120 through the step path.

In some embodiments, the drive mechanism 120 may include a resistance mechanism. For example, the drive mechanism 120 may include a magnetic resistance mechanism, a friction-based resistance mechanism, and so forth. In some embodiments, the resistance mechanism may include a flywheel, and the rotational inertia of the flywheel may contribute to the operation of the resistance mechanism. In some embodiments, a weight of the user on the steps 102 may cause the steps 102 to move along the step path from the upper portion 104 to the lower portion 106. The resistance mechanism may resist movement of the steps 102, and setting a resistance level of the resistance mechanism may help to determine the speed of movement of the steps 102.

In some embodiments, when the steps 102 reach the lower portion 106, the steps 102 may go under adjacent steps 102 (e.g., the closest step 102 above on the step path) through a transition zone of the step path to a return zone of the step path. In the transition zone, the steps 102 may remain parallel to the ground or support surface as the steps 102 reach a furthest forward position and begin to move backward. As the steps 102 pass into the transition zone, the rear set of wheels 118 may move from the rear guide track 114 to a base guide track 128. Supporting the rear set of wheels 118 on the base guide track 128 may allow the bottom step 102 to be located closer to the support surface.

In some embodiments, a rear guide support surface of the rear guide track 114 may face generally upward (e.g., toward the upper portion 104) and a base guide support surface of the base guide track 128 may face generally upward. The rear set of wheels 118 may move forward on the rear guide track 114 and rearward on the base guide track 128. In this manner, the rear guide track 114 may be disconnected and/or separate from the base guide track 128 to allow the rear set of wheels 118 to transition from forward movement on the rear guide track 114 to rearward movement on the base guide track 128. The disconnection may form a gap between the rear guide track 114 and the base guide track 128 that is at least large enough for the rear set of wheels 118 to pass through. Put another way, there may be no continuous path for the rear set of wheels 118 between the second guide track and the third guide track.

In some embodiments, the rear end 110 of the step 102 may be supported in the transition zone (e.g., in the portion of the step path where the rear end 110 is between the rear guide track 114 and the base guide track 128). This may allow the step 102 to maintain the same orientation through the transition zone of the step path. For example, supporting the rear end 110 may maintain the step 102 parallel to the support surface or approximately parallel to the support surface.

In some embodiments, supporting the rear end 110 of the step 102 may include supporting the rear set of wheels 118.

For example, a cam or other transition element may support the rear set of wheels 118 by an axle of the rear set of wheels 118. In some examples, the transition element may include one or more notches, gates, or other support elements that support the rear set of wheels 118 between the rear guide track 114 and the base guide track.

In the transition zone, the step 102 may be moved rearward as the rear end 110 is supported by the base guide track 128. The step 102 may move rearward until the drive element 122 begins to move upward. In some embodiments, the rear end 110 of the step is unsupported by the drive element 122. As the step 102 moves upward, the angle of the step 102 may change, and the rear set of wheels 118 may be lifted off the base guide track 128. In this manner, the step 102, and the rear end 110 of the step 102, may hang freely below the front end 108, which is supported by the drive element 122. The rear end 110 of the step 102 may hang freely below the drive element 122 as the drive element 122 moves the step 102 upward through the return zone (e.g., from the lower portion 106 to the upper portion) until the step 102 reaches the upper portion 104. For example, the orientation of the platform 107 when hanging freely below the drive element 122 may be vertical, or parallel with a force of gravity.

When the step 102 reaches the upper portion 104, a positioning wheel may engage with a lower surface of the platform 107 through an upper transition zone between the return zone and the support zone. This may change the orientation of the step 102 from hanging vertically below the drive element 122 to an operating position. Through the upper transition zone, the step 102 may move forward. When the drive element 122 moves into the support zone of the step path, the front set of wheels 116 may contact or engage with the front guide track 112 and the rear set of wheels 116 may contact or engage with the rear guide track 114. The step 102 may then move through the support zone. As may be understood, the step path may be a loop, or may be cyclical. Put another way, the drive mechanism 120 may move the drive element 122 through a looped path so that a limited number of steps 102 may indefinitely loop along the step path. This may allow the user to climb an infinite staircase, thereby allowing the user to experience the exercise of stair climbing from a stationary location.

Figure 2:
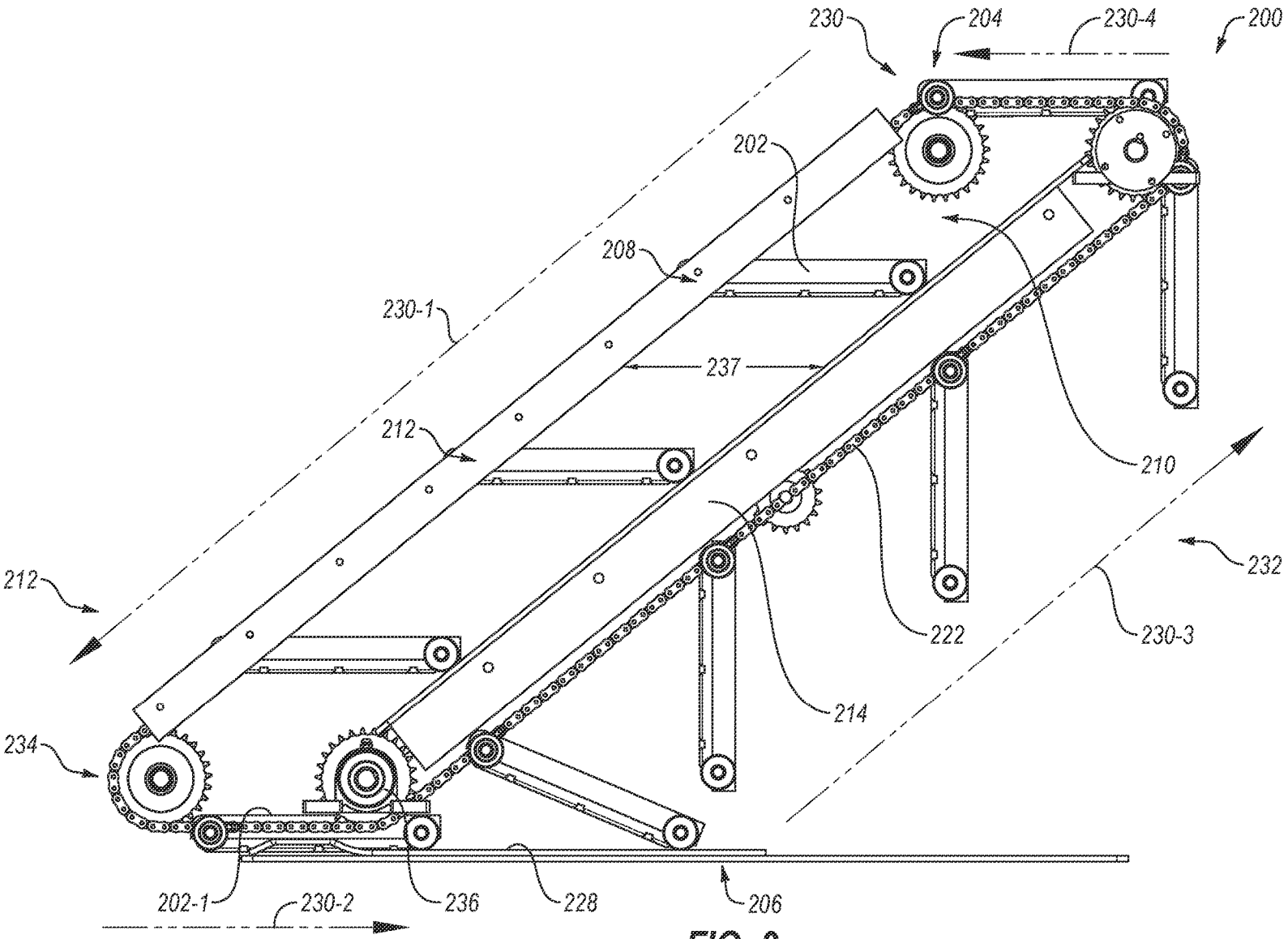
FIG. 2 is a representation of a side view of an exercise device, according to at least one embodiment of the present disclosure.

FIG. 2 is a partial cut-away side view of an exercise device 200, according to at least one embodiment of the present disclosure. The exercise device 200 includes a plurality of movable steps 202. The movable steps 202 move along a step path 230. The steps 202 are supported by a drive element 222, which causes the steps 202 to move through the portions of the step path 230. The exercise device 200 includes a rear end 232, a front end 234, an upper portion 204, and a lower portion 206. The steps 202 move along the step path 230 between the rear end 232, the front end 234, the upper portion 204, and the lower portion 206.

In the embodiment shown, the step path 230 includes a support zone 230-1, a lower transition zone 230-2, a return zone 230-3, and an upper transition zone 230-4. In the support zone 230-1, the steps 202 are supported by one or more guide tracks. For example, in the support zone 230-1, a front end 208 of the step 202 is supported by a front guide track 212 and a rear end 210 of the step 202 is supported by a rear guide track 214. As discussed herein, the steps 202 may include one or more sets of wheels that may be supported by the guide tracks. As the step 202 moves along the support zone 230-1, the wheels may roll along the guide tracks.

In the embodiment shown, the support zone 230-1 may move from the upper portion 204 to the lower portion 206 of the exercise device 200 and from the rear end 232 to the front end 234. This may allow a user to simulate climbing up a flight of stairs. However, it should be understood that, in some embodiments, the support zone 230-1 may move from the lower portion 206 to the upper portion 204 and from the front end 234 to the rear end 232. This may allow the user to simulate descending a flight of stairs.

The return zone 230-3 may return the steps 202 along the step path 230 back to the support zone 230-1. For example, in the embodiment shown, after the steps 202 descend along the support zone 230-1 to the lower portion 206 and the front end 234, the return zone 230-3 may move the steps from the lower portion 206 to the upper portion 204 and from the front end 234 to the rear end 232. However, as discussed herein, the return zone 230-3 may move the steps from the upper portion 204 to the lower portion 206 and from the rear end 232 or to the front end 234.

In the return zone 230-3, the steps 202 may only be supported by the drive element 222. For example, in the embodiment shown, the steps 202 are supported by the drive element 222 at the front end 208 of the steps. The rear end 210 of the step 202 may be free-floating below the drive element 222 so that the step 202 hangs from the drive element 222 by the front end 208. However, in some embodiments, the step 202 may be at least partially be supported by a housing, plate, or other section of the exercise device 200.

The steps 202 are located in an operating orientation in the support zone 230-1. As may be seen, in the operating orientation, the platform of the step 202 is parallel to a support surface on which the exercise device 200 is placed. On a level support surface, the platform of the step 202 may be horizontal, level, perpendicular to the force of gravity, parallel to the support surface, and so forth.

The step path 230 includes a lower transition zone 230-2 between the support zone 230-1 and the return zone 230-3. The steps 202 may move through the lower transition zone 230-2 at the lower portion 206 and the front end 234. As may be seen, in the lower transition zone 230-2, a bottom step 202-1 may be located in the operating orientation. Put another way, in the transition zone, the bottom step 202-1 may be parallel to the support surface. In some embodiments, the transition zone 230-2 may include one or more positioning elements. The positioning element may support the rear end 210 of the bottom step 202-1 through the lower transition zone 230-2. For example, the positioning element may support the rear end 210 of the bottom step 202-1 so that the bottom step 202-1 passes into the lower transition zone 230-2 with the same rotational rate as the front end 208.

The positioning element may further transfer the rear end 210 of the bottom step 202-1 from the rear guide track 214 to a base guide track 228. Utilizing the positioning element to transfer the rear end 210 of the bottom step 202-1 may reduce the height of the bottom step 202-1. This may help to reduce the step-on height of the exercise device 200, which may improve the ease-of use and/or the safety of the exercise device 200. The rear end 210 may be supported by the base guide track 228 through the lower transition zone. In some embodiments, as discussed herein, the rear end 210 of the bottom step 202-1 may include a rear set of wheels that roll along the base guide track 228. The rear set of wheels may roll along the base guide track 228 as the drive element 222 moves into the return zone 230-3. In the return zone, the front end 208 of the step 202 may be lifted toward the upper portion 204 and the rear end 232. As the front end 208 of the step 202 is lifted, the rear set of wheels may be lifted off the base guide track 228 until the step 202 is fully supported by the drive element 222.

When the steps 202 pass through the return zone 230-3 and reach the upper portion 204 and the rear end 232 of the exercise device 200, the steps 202 may pass into the upper transition zone 230-4. At the upper transition zone 230-4, a positioning wheel may engage a lower surface of the step 202 to position the step 202 into the operating position. This may change the orientation of the step 202 into the operating orientation. As the step 202 moves through the upper transition zone 230-4, the front end 208, and in particular the front set of wheels, may come into contact with and be supported by the front guide track 212. Further, in the upper transition zone 230-4, the rear end, and in particular the rear set of wheels, may come into contact and be supported by the rear guide track 214. The step 202 may then transition to the support zone 230-1. As will be understood, the step 202 may loop through the step path indefinitely. This may allow the user to climb an endless flight of stairs from a single position.

As may be seen, the step path 230 may have a parallelogram shape. The parallelogram shape may provide space in the lower transition zone 230-2 for the transfer of the step 202 between the support zone 230-1 and the return zone 230-3. For example, the length of the lower transition zone 230-2 may be at least a length of a step, thereby allowing space for the rear end 210 of the step 202 to move between the rear guide track 214 and the base guide track 228 while the front end 208 changes direction. The parallelogram shape may further provide space in the upper transition zone for the transfer of the step 202 between the return zone 230-3 and the support zone 230-1. For example, a length of the upper transition zone 230-3 may allow space for the step 202 to be placed in the operating orientation before the step 202 moves into the support zone 230-1.

While the step path 230 shown with a parallelogram shape, other shapes may be utilized. For example, the step path 230 may have a rectangular shape, an elliptical shape, a circular shape, or any other shape. Different step path 230 shapes may allow for different geometries of one or more of the support zone 230-1, the return zone 230-3, the lower transition zone 230-2, and the upper transition zone 230-4.

The shape of the step path 230 may be determined by one or more gears 236. The gears 236 may be located at the corners, inflection points, bends, or other shape-changing locations of the step path 230. The drive element 222 may be flexible and may be wrapped around one or more of the gears 236. The placement of the gears 236 may adjust the shape of the drive element 222. The drive element 222 may be any type of flexible drive element. For example, the drive element 222 may include a flexible chain, a belt, a cable, any other type of flexible drive element, and combinations thereof.

In some embodiments, the front end 208 of the step 202 may be fixed or coupled to the drive element. For example, the axle of the front set of wheels may be connected to the drive element with a rotating connection to allow the orientation of the step 202 to change with respect to the drive element 222. In some embodiments, the front end 208 of the step 202 may be longitudinally fixed to the drive element 222. Put another way, the front end 208 of the step 202 may not be movable along a length of the drive element 222. In this manner, as the drive element 222 is moved along the step path 230, the drive element 222 may move the step 202 along the step path 230. Put another way, the drive element 222 and the step 202 may move together along the step path 230.

The front guide track 212 and the rear guide track 214 are separated or offset with a step distance 237. Because the front end 208 and the rear end 210 of the step 202 are supported by the front guide track 212 and the rear guide track 214, respectively, the distance between the front guide track 212 and the rear guide track 214 may determine or affect the orientation of the platform of the step 202. In some embodiments, the step distance 237 may be the same as a wheel distance between the front set of wheels and the rear set of wheels. In this manner, during operation, the platform of the step 202 may remain horizontal, or parallel to the support surface.

Figures 1, 3:
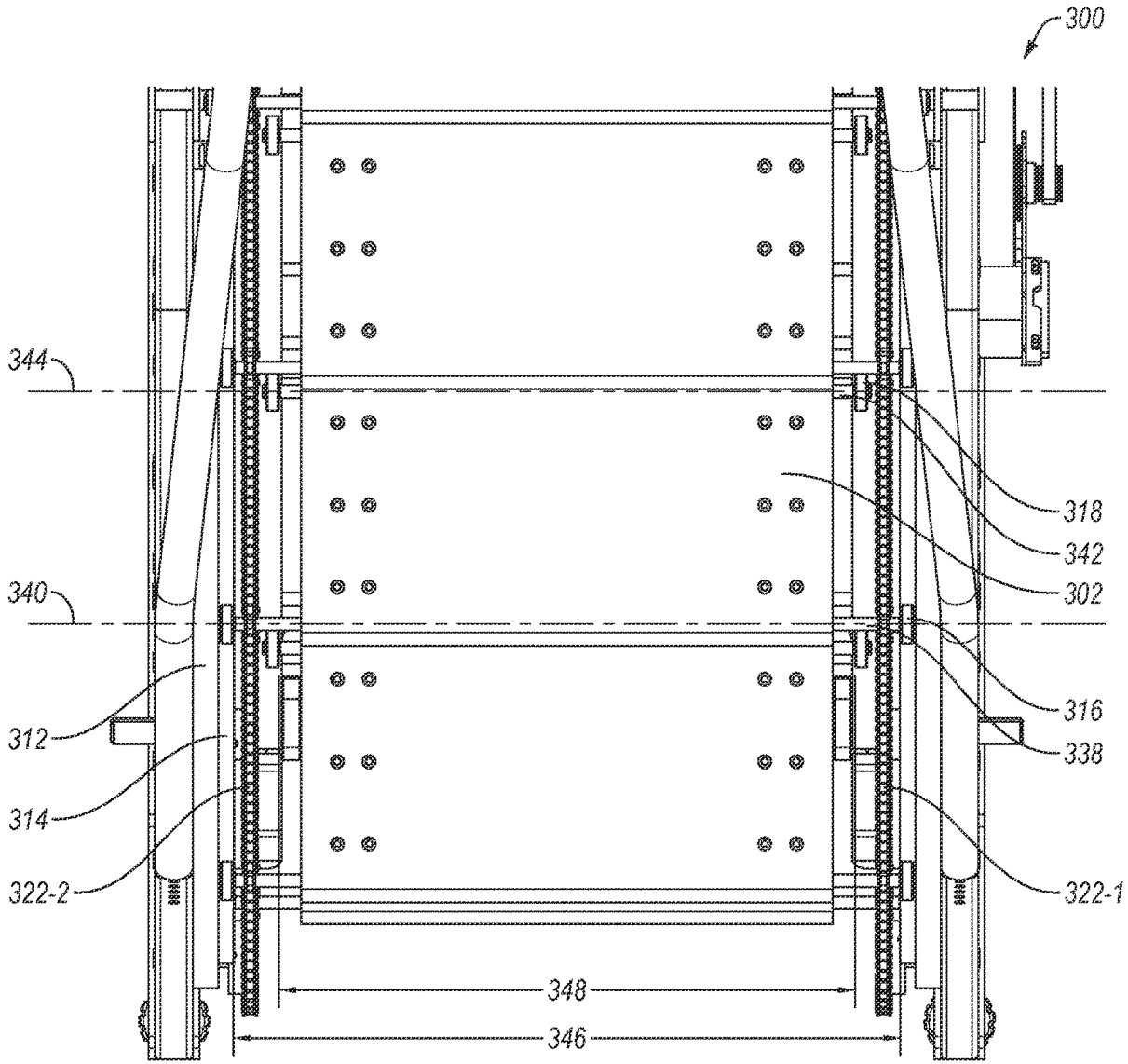
Figures 2, 3:
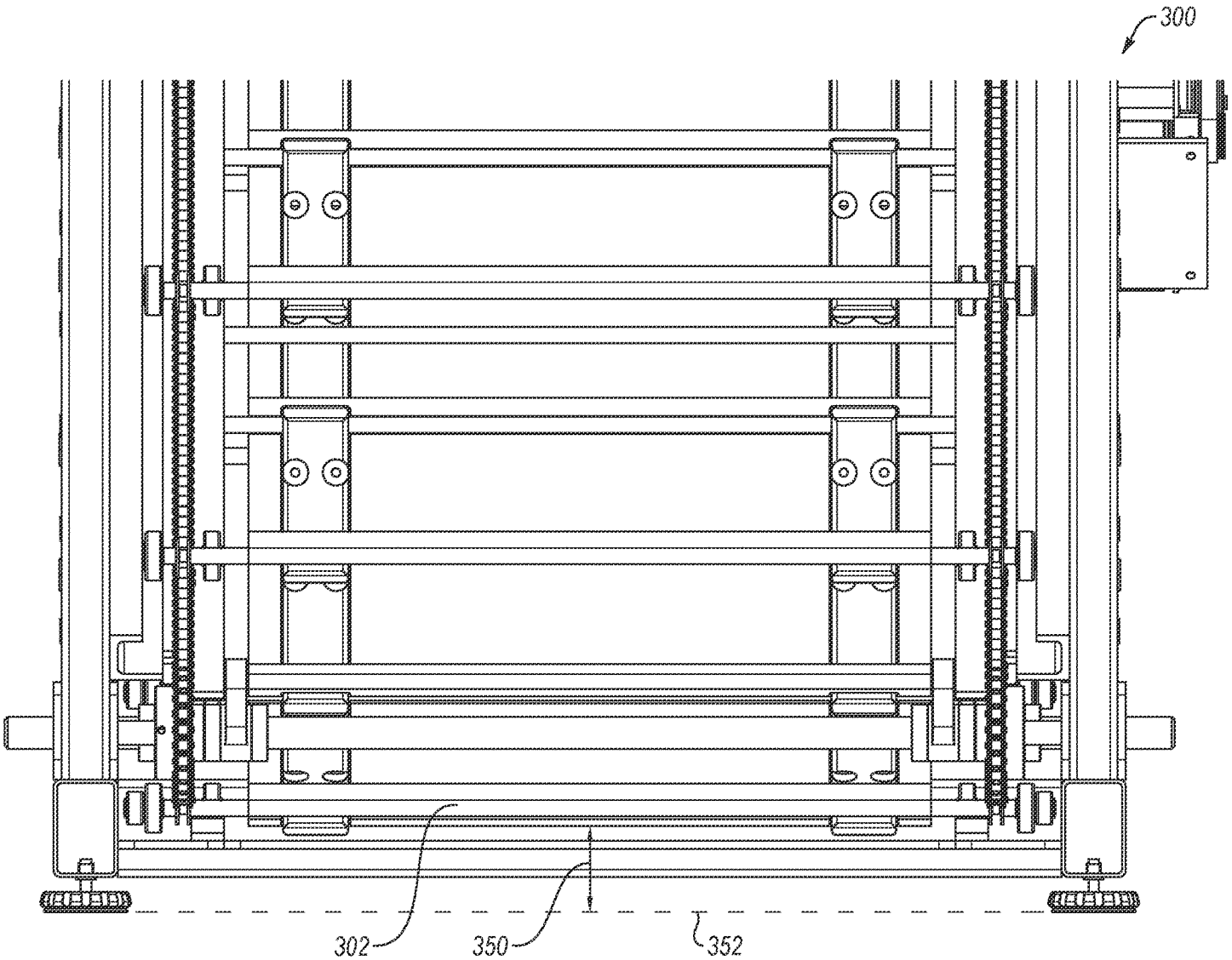

FIG. 3 is a representation of a top-down view of an exercise device 300, according to at least one embodiment of the present disclosure. The exercise device 300 includes a plurality of movable steps 302 supported by guide tracks. Each step 302 includes a front set of wheels 316 that rotate about a front axle 338 having a front axis of rotation 340. Each step 302 further includes a rear set of wheels 318 that rotate about a rear axle 342 having a rear axis of rotation 344. In the support zone of a step path, the front set of wheels 316 may be supported by a front guide track 312 and the rear set of wheels 318 may be supported by a rear guide track 314. In this manner, the front set of wheels 316 may roll along the front guide track 312 and the rear set of wheels 318 may roll along the rear guide track 314. In some embodiments, the front axis of rotation 340 may be separated from the rear axis of rotation 344 by a depth of the step. In some embodiments, the front axis of rotation 340 is parallel to the rear axis of rotation 344. In some embodiments, the front axis of rotation 340 and/or the rear axis of rotation 344 may intersect the platform. In some embodiments the front axis of rotation 340 and the rear axis of rotation 344 may be coplanar.

The steps 302 may be driven along the step path using one or more drive elements (collectively 322). The drive elements 322 may be connected to the steps 302 at the first set of wheels 316. In the embodiment shown, the drive elements 322 may be connected to the front axle 338. However, in some embodiments, the drive elements 322 may be connected directly to the step 302. In the embodiment shown, a first drive element 322-1 is connected to a first side of the front axle 338 and a second drive element 322-2 is connected to a second side of the front axle 338. Two drive elements 322 may provide additional support and alignment for the steps 302, thereby allowing the platform of the step to remain horizontal or parallel to the support surface.

The front set of wheels 316 are separated by a front separation distance 346 and the rear set of wheels 318 are separated by a rear separation distance 348. In some embodiments, the front separation distance 346 may be greater than the rear separation distance 348. In some embodiments, the front separation distance 346 may be less than the rear separation distance 348. In some embodiments, the front separation distance 346 may be less than the rear separation distance 348. In some embodiments, having a larger front separation distance 346 may allow a positioning element to grab the rear end of the step 302 without interfering with the front end of the step 302.

FIG. 3-2 is a front view of the exercise device 300 of FIG. 3-1. In the position shown, the bottom step 302 is in a bottom-most position, or a position where the bottom step 302 is closest to a supporting surface. In the bottom-most position, the bottom step 302 is located a step height 350 over a supporting surface 352. In some embodiments, the step height 350 may be in a range having an upper value, a lower value, or upper and lower values including any of 40 mm, 45 mm, 50 mm, 55 mm, 60 mm, 65 mm, 70 mm, 75 mm, 80 mm, or any value therebetween. For example, the step height 350 may be greater than 40 mm. In another example, the step height 350 may be less than 80 mm. In yet other examples, the step height 350 may be any value in a range between 40 mm and 80 mm. In some embodiments, it may be critical that the step height 350 is less than 60 mm to reduce the height for a user to mount the exercise device 300. This may help to improve the safety and/or ease-of-use of the exercise device 300.

Figures 1, 4:
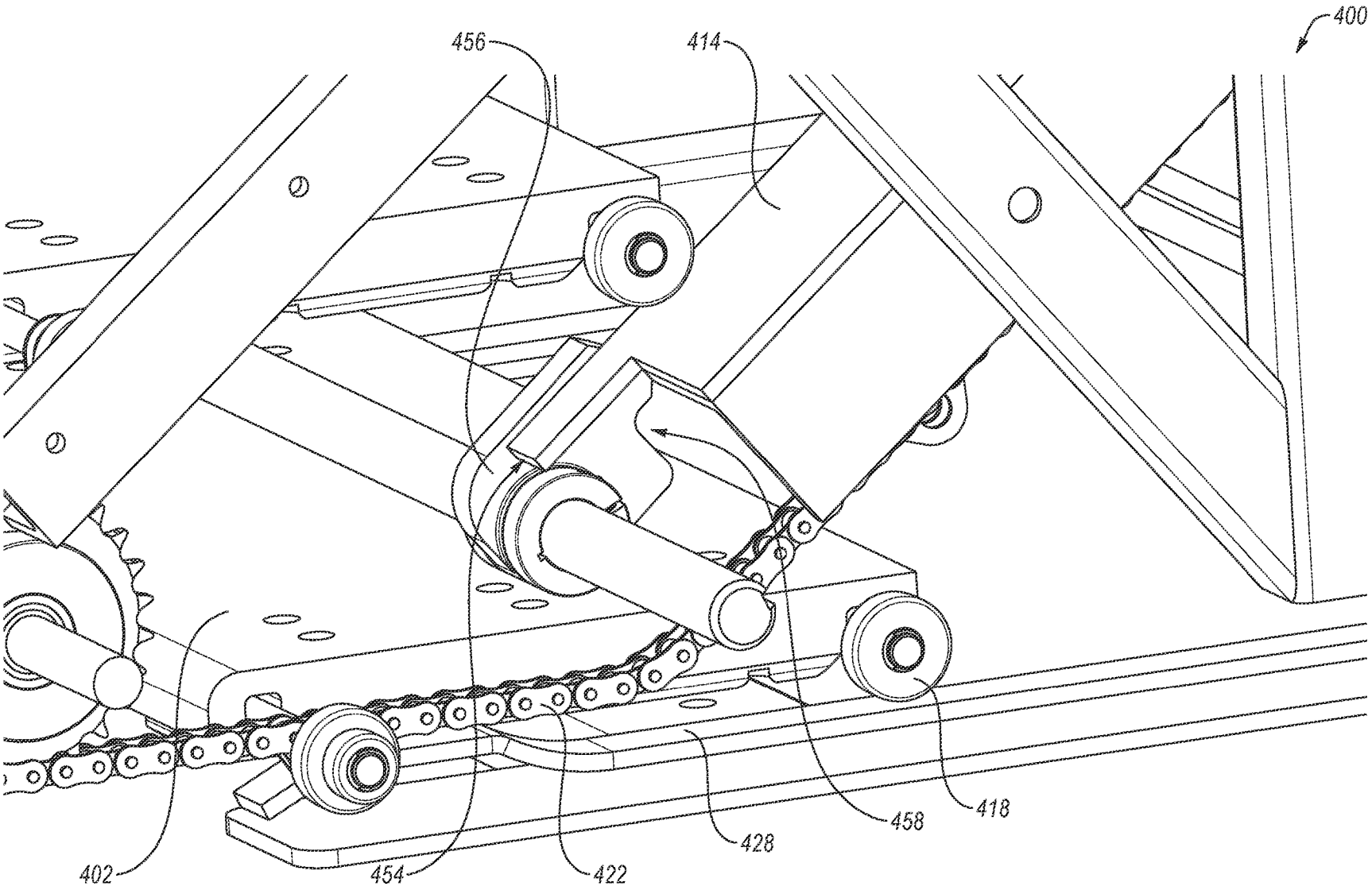
Figures 2, 4:
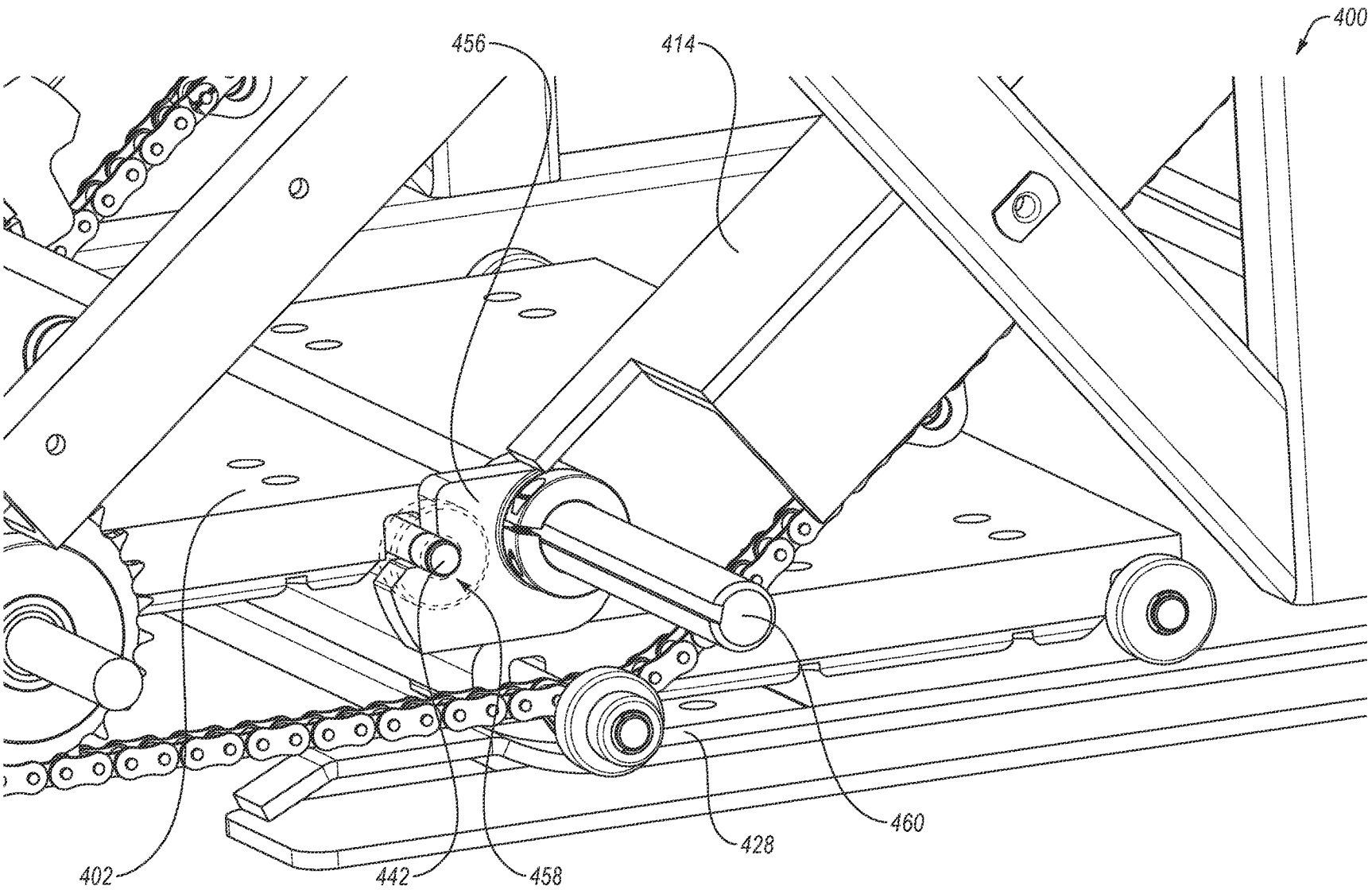
Figures 3, 4:
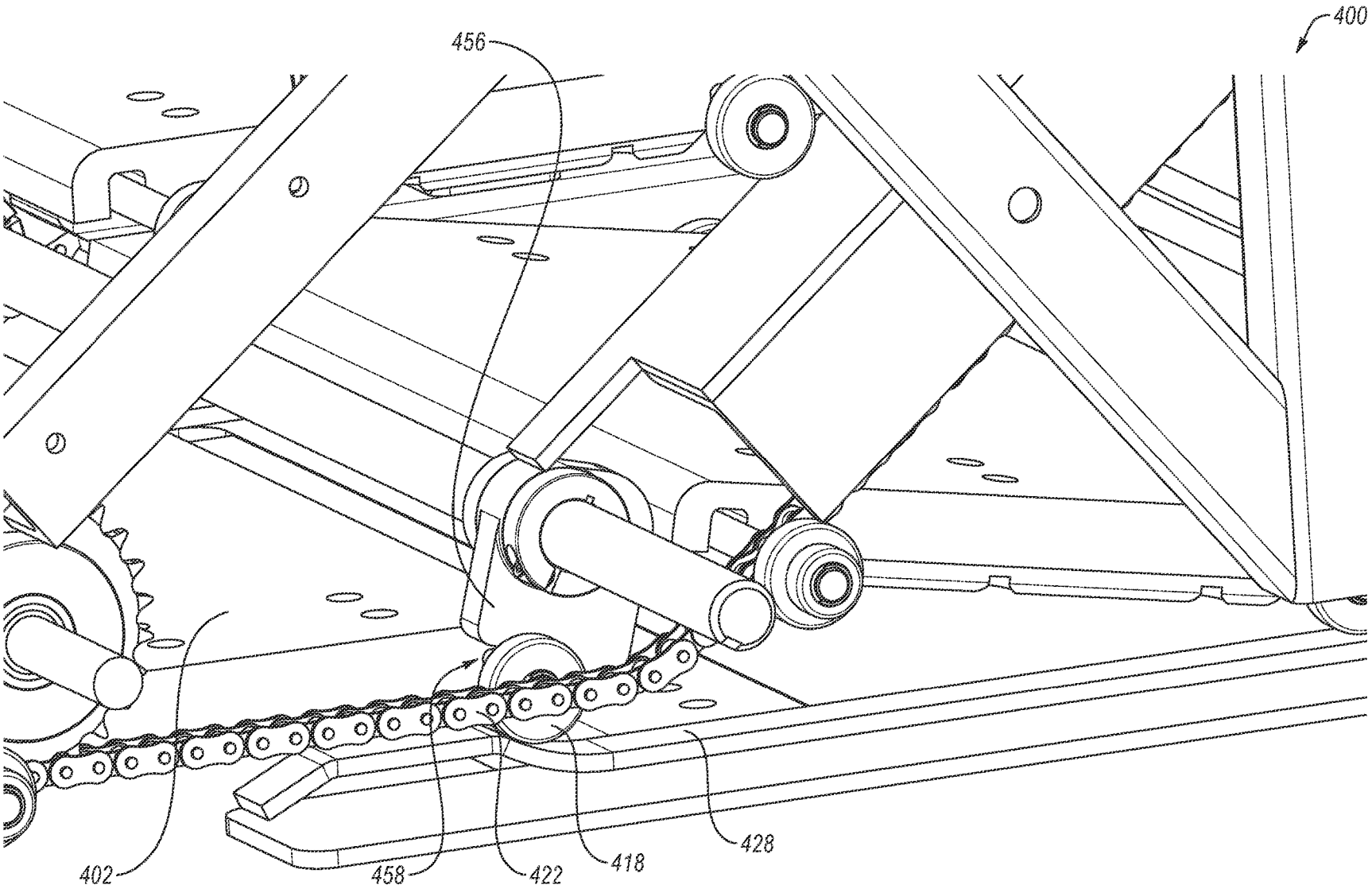

FIG. 4-1 is a representation of a lower transition zone of an exercise device 400, according to at least one embodiment of the present disclosure. In the position shown, a step 402 is passing from the support zone to the lower transition zone. The rear set of wheels 418 is supported by the rear guide track 414. As the drive element 422 moves the step 402 further along the step path, the rear set of wheels 418 may continue to roll down the rear guide track 414 until the rear set of wheels reaches a termination point 454 of the rear guide track 414.

As may be seen, a gap is formed between the rear guide track 414 and the base guide track 428 at the termination point 454. Put another way, the rear guide track 414 may not be continuous all the way to the base guide track 428, and the rear set of wheels 418 may not have a surface to roll on continuously between the rear guide track 414 and the base guide track 428.

In accordance with at least one embodiment of the present disclosure, a positioning element 456 may help to position the rear set of wheels 418 on the base guide track 428 after they leave the rear guide track 414 at the termination point 454. In some embodiments, the positioning element 456 may support the rear set of wheels 418 as the move between the rear guide track 414 and the base guide track 428. As may be seen, the positioning element 456 may be a rotatable cam. The positioning element 456 may include a catch 458. The catch 458 may support the rear end of the step 402 at the axle of the rear set of wheels 418.

In the position shown in FIG. 4-2, the rear axle 442 is seated in the catch 458 of the positioning element 456. Put another way, the catch 458 of the positioning element 456 may support the rear axle 442. In some embodiments, the positioning element 456 may be connected to a positioning axle 460. The positioning axle 460 may rotate, thereby causing the positioning element 456 to rotate. As the positioning element 456 rotates, the catch 458 may rotate, carrying the rear axle 442 with it. As the catch 458 rotates, catch 458 may deposit the rear set of wheels 418 on the base guide track 428.

In accordance with at least one embodiment of the present disclosure, the catch 458 may be offset from the positioning axle 460. The catch 458 may be positioned so that an axis of rotation of the catch 458 may be the same as an axis of rotation of a front gear about which the drive element 422 rotates and moves the front end of the step 402. With the front end and the rear end of the step 402 rotating with the same axis of rotation, the step 402 may remain horizontal and/or parallel to the supporting surface of the exercise device 400 until the rear set of wheels 418 are supported by the base guide track 428. In some embodiments, the positioning element 456 and the catch 458 may have an eccentric axis of rotation. Put another way, the catch 458 may have a non-circular rotational path, such as an elliptical path.

In the position shown in FIG. 4-3, the positioning element 456 has deposited the rear set of wheels 418 on the base guide track 428. The drive element 422 has advanced along the step path, thereby moving the rear set of wheels 418 along the base guide track 428. As may be seen, the step 402 is traveling underneath the adjacent step 402 while the rear set of wheels 418 roll along the base guide track 428. After the positioning element 456 deposits the rear set of wheels 418 on the base guide track 428, the positioning element 456 may continue to rotate into position to receive the next step 402.

In some embodiments, the positioning element 456 may be rotated based on a movement of the drive element 422. For example, the positioning axle 460 may be rotated by a gear connected to the drive element 422. This may help to keep the positioning element 456 and the catch 458 to remain coordinated with the position of various steps. In some embodiments, the positioning axle and/or the positioning element 456 may be independently rotatable. This may help to keep the positioning element 456 and the catch aligned with the rear set of wheels 418 and the rear axle 442.

In the embodiment shown, the positioning element 456 includes a single catch 458. However, it should be understood that multiple catches 458 may be located on the positioning element 456. This may help to reduce the effects of misalignment of the rear axle 442 with the catches 458 by providing multiple catches 458 to collect the rear axle 442.

In some embodiments, the positioning element 456 may include any type of catch 458 or other element used to support the rear axle 442. For example, the positioning element 456 may include one or more gates, snaps, hooks, magnets, or other elements that may be used to support the rear axle in the lower transition zone.

In some embodiments, the exercise device 400 may include two positioning elements 456 located on opposite sides of the step 402. The two positioning elements may support the rear end of the step 402 on either side of the step 402, thereby helping to maintain the orientation of the platform of the step 402.

Figure 5:
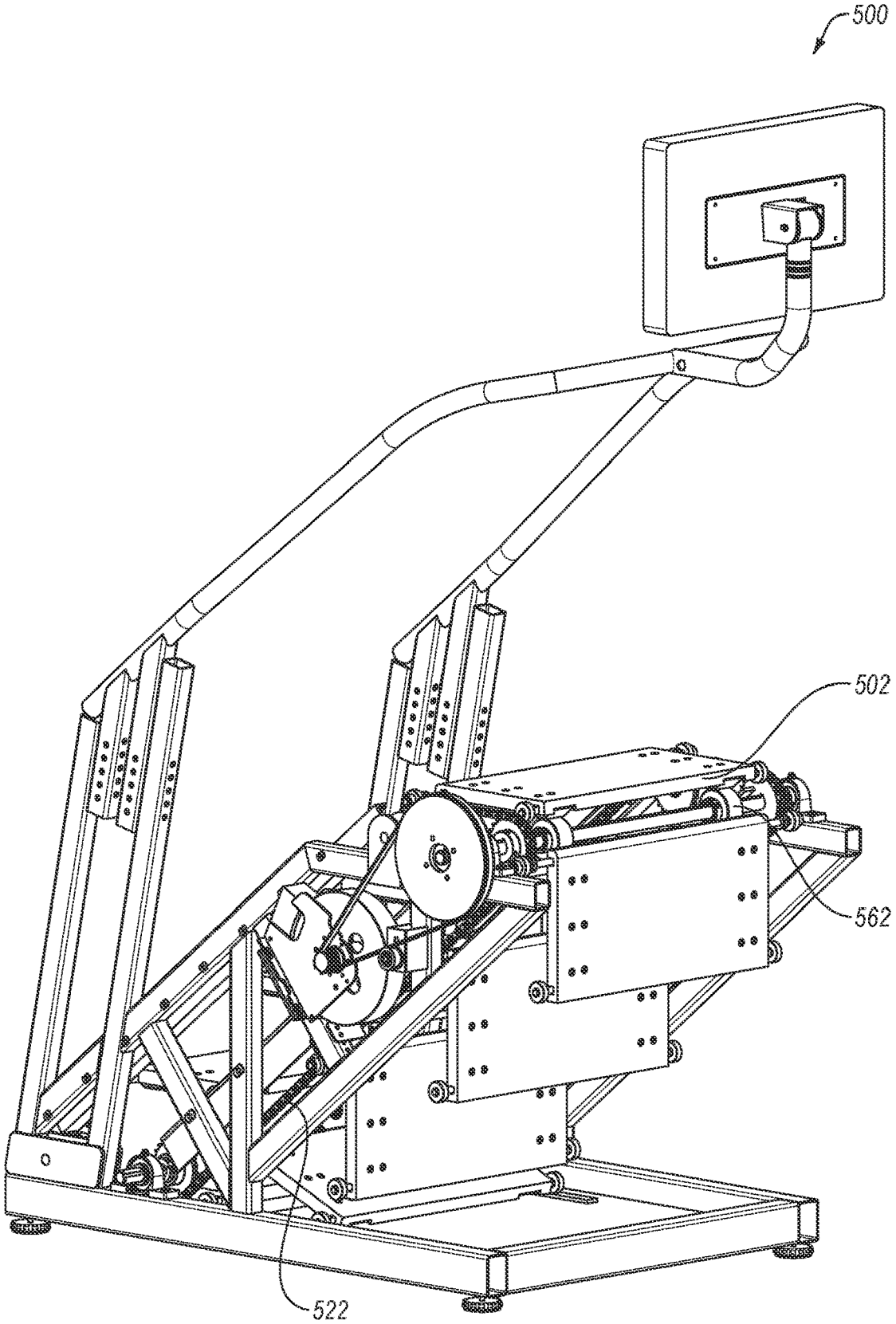
FIG. 5 is a representation of a rear perspective view of an exercise device, according to at least one embodiment of the present disclosure.

FIG. 5 is a representation of a rear perspective view of an exercise device 500 with a step 502 moving from the return zone to the upper transition zone, according to at least one embodiment of the present disclosure. As may be seen, in the return zone, the steps 502 may be hanging below the drive element 522. When the steps 502 reach the top of the return zone and enter the upper transition zone, the steps 502 may change orientation from hanging below the drive element 522 (e.g., vertical, perpendicular to the support surface, parallel to the force of gravity) to the operating orientation.

In some embodiments, to facilitate the change in orientation to the operating orientation, a positioning wheel 562 may be located at the upper rear end of the step path of the drive element 522. When the step 502 reaches the upper transition zone, the positioning wheel 562 may engage the lower surface of the step 502. As the step moves forward through the upper transition zone, the positioning wheel 562 may move the step 502 into the operating orientation. In some embodiments, the lower surface of the step may include one or more runners. The runners may be configured to engage with the positioning wheel 562. The positioning wheel 562 may roll along the runners, thereby pushing the step 502 into the operating orientation.

Figure 6:
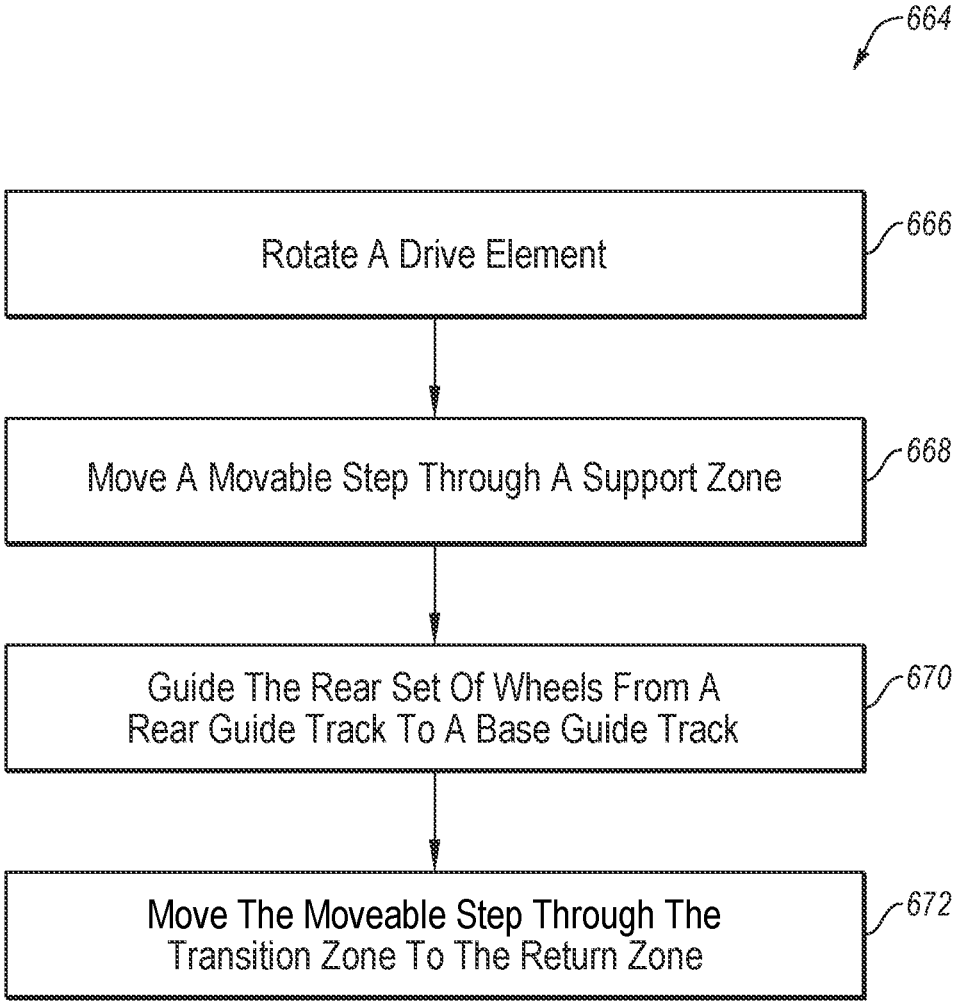
FIG. 6 is a flowchart of a method for operating an exercise device, according to at least one embodiment of the present disclosure.

FIG. 6 is a flowchart of a method 664 for operating an exercise device, according to at least one embodiment of the present disclosure. The method 664 may include rotating a drive element through a step path at 666. The drive element is coupled to a movable step. The step path includes a support zone, a return zone, and a transition zone between the support zone and the return zone. The method 664 includes moving the movable step through the support zone at 668. A front set of wheels are connected to a front end of the movable step and are supported by a first guide track in the support zone. A rear set of wheels are connected to a rear end of the movable step and are supported by a rear guide track in the support zone.

In the transition zone, the rear set of wheels are guided from the rear guide track to the base guide track using a positioning element at 670. The movable step may then be moved through the transition zone to the return zone at 672. In the transition zone, the rear set of wheels are supported by and may roll along the base guide track.

Industrial Applicability

This disclosure generally relates to devices, systems, and methods for operation of an exercise device. The exercise device includes a plurality of movable steps. The movable steps move around a step path from an upper portion of the exercise device to a lower portion of the exercise device. When the steps reach the lower portion of the exercise device, the steps may loop around and return to the upper portion. The steps follow a step path. In a support zone of the step path, the steps may move from the upper portion to the lower portion. In the support zone, a front set of wheels connected to a front side of the step are supported and roll along a front guide track and a rear set of wheels connected to a rear side of the steps are supported and roll along a rear guide track. At the lower portion of the exercise device, the rear set of wheels may transfer from the rear guide track to a base guide track. This may allow the step to remain parallel to the support surface as it transfers from the step portion to a return zone of the step path. This may help to lower a height from the platform of the step to the support surface.

In accordance with at least one embodiment of the present disclosure, in the transition zone of the step path between the support zone and the return zone, a positioning element may guide the rear set of wheels from the rear guide track to the base guide track. The positioning element may support the rear set of wheels as they leave the rear guide track and contact or engage the base guide track. In some embodiments, the positioning element may include any element, such as a cam, a latch, a magnet, any other positioning element, and combinations thereof.

The step may be moved through the step path by a drive mechanism. The drive mechanism may be connected to the step at a front side of the step. For example, the drive mechanism may include a drive element, such as a chain or a belt. The drive element may be connected to an axle of the front set of wheels. The rear side of the step may be free-floating and not directly connected to the drive element. As the step moves through the return zone of the step path, the rear side of the step and the rear set of wheels may hang below the front side of the step. This may place the step in a vertical position (e.g., parallel to the force of gravity, approximately perpendicular to the support surface).

When the step reaches the upper portion of the exercise device, a positioning wheel may engage the step at a bottom side of the step. The positioning wheel may push the step from the vertical position to the horizontal position when the step transitions from the return zone to the support zone of the step path. In some embodiments, the positioning wheel may engage a runner on the bottom side of the step to position the step in a support position.

In some embodiments, an exercise device may simulate climbing stairs. The exercise device may include a plurality of movable steps. The steps may move from an upper portion of the exercise device to a lower portion of the exercise device. As the steps move from the upper portion to the lower portion, a user may "climb" stairs by stepping on a platform of successive steps as they are revealed and moved between the upper portion and the lower portion. In this manner, the user may perform an exercise activity that simulates climbing a flight of stairs on the exercise device.

The steps may have a front end and a rear end. As the steps move from the upper portion to the lower portion, the front end may be supported by a front guide track. The rear end may be supported by a rear guide track. In some embodiments, a front set of wheels may be connected to the front end of the step and a rear set of wheels may be connected to the rear end of the step. As the step moves from the upper portion to the lower portion, the front set of wheels may be supported by and/or roll along the front guide track and the rear set of wheels may be support by and/or roll along the rear guide track. The front guide track and the rear guide track may support the weight of the user as the user steps on the platform of the steps. In some embodiments, the front guide track may be parallel to the rear guide track.

In some embodiments, a drive mechanism may move the steps along the step path. The drive mechanism may include a drive element. The drive element may be connected to the steps. In accordance with at least one embodiment of the present disclosure, the drive element may be connected to each step at the front end of the platform. As the drive element moves along the step path, the steps may move along the step path as well. In accordance with at least one embodiment of the present disclosure, the drive element may rotate along the step path from the upper portion to the lower portion, thereby allowing the user to climb up the steps. In some embodiments, the drive element may rotate along the step path from the lower portion to the upper portion. This may allow the user to walk or climb down the steps.

In some embodiments, the drive mechanism may include a motor. The motor may be connected to one or more drive elements. The drive elements may be connected to our coupled with the drive element. In this manner, when the motor rotates the drive elements, the drive elements may cause the drive element to move. In some embodiments, the drive mechanism may include a flywheel or other energy storage device. The flywheel may help to maintain a smooth rotation or movement of the drive mechanism through the step path.

In some embodiments, the drive mechanism may include a resistance mechanism. For example, the drive mechanism may include a magnetic resistance mechanism, a friction-based resistance mechanism, and so forth. In some embodiments, the resistance mechanism may include a flywheel, and the rotational inertia of the flywheel may contribute to the operation of the resistance mechanism. In some embodiments, a weight of the user on the steps may cause the steps to move along the step path from the upper portion to the lower portion. The resistance mechanism may resist movement of the steps, and setting a resistance level of the resistance mechanism may help to determine the speed of movement of the steps.

In some embodiments, when the steps reach the lower portion, the steps may pass under adjacent steps (e.g., the closest step above on the step path) through a transition zone of the step path to a return zone of the step path. In the transition zone, the steps may remain parallel to the ground or support surface as the steps reach a furthest forward position and begin to move backward. As the steps pass into the transition zone, the rear set of wheels may move from the rear guide track to a base guide track. Supporting the rear set of wheels on the base guide track may allow the bottom step to be located closer to the support surface.

In some embodiments, a rear guide support surface of the rear guide track may face generally upward (e.g., toward the upper portion) and a base guide support surface of the base guide track may face generally upward. The rear set of wheels may move forward on the rear guide track and rearward on the base guide track. In this manner, the rear guide track may be disconnected and/or separate from the base guide track to allow the rear set of wheels to transition from forward movement on the rear guide track to rearward movement on the base guide track. The disconnection may form a gap between the rear guide track and the base guide track that is at least large enough for the rear set of wheels to pass through. Put another way, there may be no continuous path for the rear set of wheels between the second guide track and the third guide track.

In some embodiments, the rear portion of the step may be supported in the transition zone (e.g., in the portion of the step path where the rear portion is between the rear guide track and the base guide track). This may allow the step to maintain the same orientation through the transition zone of the step path. For example, supporting rear portion may maintain the step parallel to the support surface or approximately parallel to the support surface.

In some embodiments, supporting the rear portion of the step may include supporting the rear set of wheels. For example, a cam or other transition element may support the rear set of wheels by an axle of the rear set of wheels. In some examples, the transition element may include one or more notches, gates, or other support elements that support the rear set of wheels between the rear guide track and the base guide track.

In the transition zone, the step may be moved rearward as the rear portion is supported by the base guide track. The step may move rearward until the drive element begins to move upward. In some embodiments, the rear portion of the step is unsupported by the drive element. As the step moves upward, the angle of the step may change, and the rear set of wheels may be lifted off the base guide track. In this manner, the step, and the rear end of the step, may hang freely below the front end, which is supported by the drive element. The rear end of the step may hang freely below the drive element as the drive element moves the step upward through the return zone (e.g., from the lower portion to the upper portion) until the step reaches the upper portion. For example, the orientation of the platform when hanging freely below the drive element may be vertical, or parallel with a force of gravity.

When the step reaches the upper portion, a positioning wheel may engage with a lower surface of the platform through an upper transition zone between the return zone and the support zone. This may change the orientation of the step from hanging vertically below the drive element to an operating position. Through the upper transition zone, the step may move forward. When the drive element moves into the support zone of the step path, the front set of wheels may contact or engage with the front guide track and the rear set of wheels may contact or engage with the rear guide track. The step may then move through the support zone. As may be understood, the step path may be a loop, or may be cyclical. Put another way, the drive mechanism may move the drive element through a looped path so that a limited number of steps may indefinitely loop along the step path. This may allow the user to climb an infinite staircase, thereby allowing the user to experience the exercise of stair climbing from a stationary location.

In some embodiments, the movable steps may move along a step path. The steps are supported by a drive element, which causes the steps to move through the portions of the step path. The exercise device includes a rear end, a front end, an upper portion, and a lower portion. The steps move along the step path between the rear end, the front end, the upper portion, and the lower portion.

In some embodiments, the step path includes a support zone, a lower transition zone, a return zone, and an upper transition zone. In the support zone, the steps are supported by one or more guide tracks. For example, in the support zone, a front end of the step is supported by a front guide track and a rear end of the step is supported by a rear guide track. As discussed herein, the steps may include one or more sets of wheels that may be supported by the guide tracks. As the step moves along the support zone, the wheels may roll along the guide tracks.

In some embodiments, the support zone may move from the upper portion to the lower portion of the exercise device and from the rear end to the front end. This may allow a user to simulate climbing up a flight of stairs. However, it should be understood that, in some embodiments, the support zone may move from the lower portion to the upper portion and from the front end to the rear end. This may allow the user to simulate descending a flight of stairs.

The return zone may return the steps along the step path back to the support zone. For example, in the embodiment shown, after the steps descend along the support zone to the lower portion and the front end, the return zone may move the steps from the lower portion to the upper portion and from the front end to the rear end. However, as discussed herein, the return zone may move the steps from the upper portion to the lower portion and from the rear end or to the front end.

In the return zone, the steps may only be supported by the drive element. For example, in the embodiment shown, the steps are supported by the drive element at the front end of the steps. The rear end of the step may be free-floating below the drive element so that the step hangs from the drive element by the front end. However, in some embodiments, the step may be at least partially supported by a housing, plate, or other section of the exercise device.

The steps are located in an operating orientation in the support zone. As may be seen, in the operating orientation, the platform of the step is parallel to a support surface on which the exercise device is placed. On a level support surface, the platform of the step may be horizontal, level, perpendicular to the force of gravity, parallel to the support surface, and so forth.

The step path includes a lower transition zone between the support zone and the return zone. The steps may move through the lower transition zone at the lower portion and the front end. As may be seen, in the lower transition zone, a bottom step may be located in the operating orientation. Put another way, in the transition zone, the bottom step may be parallel to the support surface. In some embodiments, the transition zone may include one or more positioning elements. The positioning element may support the rear end of the bottom step through the lower transition zone. For example, the positioning element may support the rear end of the bottom step so that the bottom step passes into the lower transition zone with the same rotational rate as the front end.

The positioning element may further transfer the rear end of the bottom step from the rear guide track to a base guide track. Utilizing the positioning element to transfer the rear end of the bottom step may reduce the height of the bottom step. This may help to reduce the step-on height of the exercise device, which may improve the ease-of use and/or the safety of the exercise device. The rear end may be supported by the base guide track through the lower transition zone. In some embodiments, as discussed herein, the rear end of the bottom step may include a rear set of wheels that roll along the base guide track. The rear set of wheels may roll along the base guide track as the drive element moves into the return zone. In the return zone, the front end of the step may be lifted toward the upper portion and the rear end. As the front end of the step is lifted, the rear set of wheels may be lifted off the base guide track until the step is fully supported by the drive element.

When the steps pass through the return zone and reach the upper portion and the rear end of the exercise device, the steps may pass into the upper transition zone. At the upper transition zone, a positioning wheel may engage a lower surface of the step to position the step into the operating position. This may change the orientation of the step into the operating orientation. As the step moves through the upper transition zone, the front end, and in particular the front set of wheels, may come into contact with and be supported by the front guide track. Further, in the upper transition zone, the rear end, and in particular the rear set of wheels, may come into contact and be supported by the rear guide track. The step may then transition to the support zone. As will be understood, the step may loop through the step path indefinitely. This may allow the user to climb an endless flight of stairs from a single position.

The step path may have a parallelogram shape. The parallelogram shape may provide space in the lower transition zone for the transfer of the step between the support zone and the return zone. For example, the length of the lower transition zone may be at least a length of a step, thereby allowing space for the rear end of the step to move between the rear support track and the base support track while the front end changes direction. The parallelogram shape may further provide space in the upper transition zone for the transfer of the step between the return zone and the support zone. For example, a length of the upper transition zone may allow space for the step to be placed in the operating orientation before the step moves into the support zone.

While the step path shown with a parallelogram shape, other shapes may be utilized. For example, the step path may have a rectangular shape, an elliptical shape, a circular shape, or any other shape. Different step path shapes may allow for different geometries of one or more of the support zone, the return zone, the lower transition zone, and the upper transition zone.

The shape of the step path may be determined by one or more gears. The gears may be located at the corners, inflection points, bends, or other shape-changing locations of the step path. The drive element may be flexible and may be wrapped around one or more of the gears. The placement of the gears may adjust the shape of the drive element. The drive element may be any type of flexible drive element. For example, the drive element may include a flexible chain, a belt, a cable, any other type of flexible drive element, and combinations thereof.

In some embodiments, the front end of the step may be fixed or coupled to the drive element. For example, the axle of the front set of wheels may be connected to the drive element with a rotating connection to allow the orientation of the step to change with respect to the drive element. In some embodiments, the front end of the step may be longitudinally fixed to the drive element. Put another way, the front end of the step may not be movable along a length of the drive element. In this manner, as the drive element is moved along the step path, the drive element may move the step along the step path. Put another way, the drive element and the step may move together along the step path.

The front guide track and the rear guide track are separated or offset with a step distance. Because the front end and the rear end of the step are supported by the front guide track and the rear guide track, respectively, the distance between the front guide track and the rear guide track may determine or affect the orientation of the platform of the step. In some embodiments, the step distance may be the same as a wheel distance between the front set of wheels and the rear set of wheels. In this manner, during operation, the platform of the step may remain horizontal, or parallel to the support surface.

An exercise device includes a plurality of movable steps supported by guide tracks. Each step includes a front set of wheels that rotate about a front axle having a front axis of rotation. Each step further includes a rear set of wheels that rotate about a rear axle having a rear axis of rotation. In the support zone of a step path, the front set of wheels may be supported by a front guide track and the rear set of wheels may be supported by a rear guide track. In this manner, the front set of wheels may roll along the front guide track and the rear set of wheels may roll along the rear guide track. In some embodiments, the front axis of rotation may be separated from the rear axis of rotation by a depth of the step. In some embodiments, the front axis of rotation is parallel to the rear axis of rotation. In some embodiments, the front axis of rotation and/or the rear axis of rotation may intersect the platform. In some embodiments the front axis of rotation and the rear axis of rotation may be coplanar.

The steps may be driven along the step path using one or more drive elements. The drive elements may be connected to the steps at the first set of wheels. In the embodiment shown, the drive elements may be connected to the front axle. However, in some embodiments, the drive elements may be connected directly to the step. In the embodiment shown, a first drive element is connected to a first side of the front axle and a second drive element is connected to a second side of the front axle. Two drive elements may provide additional support and alignment for the steps, thereby allowing the platform of the step to remain horizontal or parallel to the support surface.

The front set of wheels are separated by a front separation distance and the rear set of wheels are separated by a rear separation distance. In some embodiments, the front separation distance may be greater than the rear separation distance. In some embodiments, the front separation distance may be less than the rear separation distance. In some embodiments, the front separation distance may be less than the rear separation distance. In some embodiments, having a larger front separation distance may allow a positioning element to grab the rear end of the step without interfering with the front end of the step.

In some embodiments, the bottom stair is in a bottom-most position, or a position where the bottom stair is closest to a supporting surface. In the bottom-most position, the bottom stair is located a step height over a supporting surface. In some embodiments, the step height may be in a range having an upper value, a lower value, or upper and lower values including any of 40 mm, 45 mm, 50 mm, 55 mm, 60 mm, 65 mm, 70 mm, 75 mm, 80 mm, or any value therebetween. For example, the step height may be greater than 40 mm. In another example, the step height may be less than 80 mm. In yet other examples, the step height may be any value in a range between 40 mm and 80 mm. In some embodiments, it may be critical that the step height is less than 60 mm to reduce the height for a user to mount the exercise device. This may help to improve the safety and/or ease-of-use of the exercise device.

In some embodiments, a step is passing from the support zone to the lower transition zone. The rear set of wheels is supported by the rear guide track. As the drive element moves the step further along the step path, the rear set of wheels may continue to roll down the rear guide track until the rear set of wheels reaches a termination point of the rear guide track.

A gap is formed between the rear guide track and the base guide track at the termination point. Put another way, the rear guide track may not be continuous all the way to the base guide track, and the rear set of wheels may not have a surface to roll on continuously between the rear guide track and the base guide track.

In accordance with at least one embodiment of the present disclosure, a positioning element may help to position the rear set of wheels on the base guide track after they leave the rear guide track at the termination point. In some embodiments, the positioning element may support the rear set of wheels as the move between the rear guide track and the base guide track. As may be seen, the positioning element may be a rotatable cam. The positioning element may include a catch. The catch may support the rear end of the step at the axle of the rear set of wheels.

The rear axle may be seated in the catch of the positioning element. Put another way, the catch of the positioning element may support the rear axle. In some embodiments, the positioning element may be connected to a positioning axle. The positioning axle may rotate, thereby causing the positioning element to rotate. As the positioning element rotates, the catch may rotate, carrying the rear axle with it. As the catch rotates, catch may deposit the rear set of wheels on the base guide track.

In accordance with at least one embodiment of the present disclosure, the catch may be offset from the positioning axle. The catch may be positioned so that an axis of rotation of the catch may be the same as an axis of rotation of a front gear about which the drive element rotates and moves the front end of the step. With the front end and the rear end of the step rotating with the same axis of rotation, the step may remain horizontal and/or parallel to the supporting surface of the exercise device until the rear set of wheels are supported by the base guide track. In some embodiments, the positioning element and the catch may have an eccentric axis of rotation. Put another way, the catch may have a non-circular rotational path, such as an elliptical path.

In some embodiments, the drive element has advanced along the step path, thereby moving the rear set of wheels along the base guide track. As may be seen, the step is traveling underneath the adjacent step while the rear set of wheels roll along the base guide track. After the positioning deposits the rear set of wheels on the base guide track, the positioning element may continue to rotate into position to receive the next step.

In some embodiments, the positioning element may be rotated based on a movement of the drive element. For example, the positioning axle may be rotated by a gear connected to the drive element. This may help to keep the positioning element and the catch to remain coordinated with the position of various steps. In some embodiments, the positioning axle and/or the positioning element may be independently rotatable. This may help to keep the positioning element and the catch aligned with the rear set of wheels and the rear axle.

In some embodiments, the positioning element includes a single catch. However, it should be understood that multiple catches may be located on the positioning element. This may help to reduce the effects of misalignment of the rear axle with the catches by providing multiple catches to collect the rear axle.

In some embodiments, the positioning element may include any type of catch or other element used to support the rear axle. For example, the positioning element may include one or more gates, snaps, hooks, magnets, or other elements that may be used to support the rear axle in the lower transition zone.

In some embodiments, the exercise device may include two positioning elements located on opposite sides of the step. The two positioning elements may support the rear end of the step on either side of the step, thereby helping to maintain the orientation of the platform of the step.

In some embodiments, in the return zone, the steps may be hanging below the drive element. When the steps reach the top of the return zone and enter the upper transition zone, the steps may change orientation from hanging below the drive element (e.g., vertical, perpendicular to the support surface, parallel to the force of gravity) to the operating orientation.

In some embodiments, to facilitate the change in orientation to the operating orientation, a positioning wheel may be located at the upper rear end of the step path of the drive element. When the step reaches the upper transition zone, the positioning wheel may engage the lower surface of the step. As the step moves forward through the upper transition zone, the positioning wheel may move push the step into the operating orientation. In some embodiments, the lower surface of the step may include one or more runners. The runners may be configured to engage with the positioning wheel. The positioning wheel may roll along the runners, thereby pushing the step into the operating orientation.

In some embodiments, a method for operating an exercise device may include rotating a drive element through a step path. The drive element is coupled to a movable step. The step path includes a support zone, a return zone, and a transition zone between the support zone and the return zone. The method includes moving the movable step through the support zone. A front set of wheels are connected to a front end of the movable step and are supported by a first guide track in the support zone. A rear set of wheels are connected to a rear end of the movable step and are supported by a rear guide track in the support zone.

In the transition zone, the rear set of wheels are guided from the rear guide track to the base guide track using a positioning element. The movable step may then be moved through the transition zone to the return zone. In the transition zone, the rear set of wheels are supported by and may roll along the base guide track.

Following are sections in accordance with the present disclosure:

A1. A movable step comprising:

a platform;

a drive mechanism movable along a step path, the step path having a support zone, a transition zone, and a return zone, the platform being connected to the drive mechanism and movable along the step path;

a front wheel connected to a front side of the platform, the front wheel being supported by a first guide track when the platform is in the support zone; and a rear wheel connected to a rear side of the platform, the rear wheel being supported by a second guide track when the platform is in the support zone, the rear wheel being supported by a third guide track when the platform is in the transition zone.

A2. The movable step of section A1, wherein the third guide track is separate from the second guide track.

A3. The movable step of section A2, wherein there is no continuous path for the rear wheel between the second guide track and the third guide track.

A4. The movable step of any of sections A1-A3, wherein the front wheel rotates along a first axis of rotation and the second wheel rotates along a second axis of rotation.

A5. The movable step of section A4, wherein the first axis of rotation is different than the second axis of rotation.

A6. The movable step of section A4 or A5, wherein the first axis of rotation is separated from the second axis of rotation by a depth of the step.

A7. The movable step of any of sections A4-A6, wherein the first axis of rotation is parallel to the second axis of rotation.

A8. The movable step of any of sections A4-A7, wherein the first axis of rotation and the second axis of rotation intersect the platform.

A9. The movable step of any of sections A4-A8, wherein the first axis of rotation and the second axis of rotation are coplanar.

A10. The movable step of any of sections A4-A9, wherein the drive mechanism is coupled to the base at the first axis of rotation.

A11. The movable step of any of sections A1-A10, wherein the front wheel includes a first front wheel and a second front wheel, the first front wheel being separated from the second front wheel with a first difference, and wherein the rear wheel includes a first rear wheel and a second rear wheel, the first rear wheel and the second rear wheel being separated by a second distance.

A12. The movable step of section A11, wherein the first distance is the same as the second distance.

A13. The movable step of section A11 or A12, wherein the first distance is different from the second distance.

A14. The movable step of any of sections A11-A13, wherein the first distance is greater than the second distance.

A15. The movable step of any of sections A1-A14, wherein the first guide track and the second guide track are parallel.

A16. The movable step of any of sections A1-A15, wherein the drive mechanism is connected to the base with a pivoting connection.

A17. The movable step of any of sections A1-A16, wherein the front side of the base corresponds to a side closest to a user of the movable step.

A18. The movable step of any of sections A1-A17, further comprising at least one runner positioned on the bottom of the base.

A19. The movable step of section A18, wherein the runner is configured to engage at least one positioning wheel to position the platform into an operating position when the drive mechanism moves into the support position.

A20. The movable step of any of sections A1-A19, wherein the drive mechanism is connected to the platform at a lateral side of the platform, and wherein the lateral side is adjacent to the front side and the rear side.

A21. The movable step of any of sections A1-A20, wherein the drive mechanism includes:

a first drive element connected to the platform on a first lateral side of the platform; and a second drive element connected to the platform on a second lateral side of the platform opposite the first lateral side.

A22. The movable step of section A21, wherein the first drive element is rotationally coupled to the second drive element.

A23. The movable step of section A21 or A22, wherein the drive element and the second drive element are independently rotatable.

A24. The movable step of any of sections A1-A23, wherein an operating surface of the platform is planar.

A25. The movable step of any of sections A1-A24, wherein the platform is configured to support the weight of a user.

A26. The movable step of any of sections A1-A25, wherein the platform has a width to accommodate both of a user's feet.

B1. An exercise device, comprising:

a plurality of movable steps, each movable step of the plurality of movable steps including:

a platform;

a front set of wheels connected to a front side of the platform;

a rear set of wheels connected to a rear side of the platform;

a front guide track;

a rear guide track;

a base guide track, the base guide track being disconnected from the rear guide track;

a drive mechanism connected to each movable step of the plurality of movable steps, the drive mechanism moving the plurality of movable steps in a step path, wherein the step path includes a support zone, a return zone, and a transition zone between the support zone and the return zone, and wherein, in the support zone, the front set of wheels roll along the front guide track and the rear set of wheels roll along the rear guide track, and wherein, in the transition zone, the rear set of wheels roll along the base guide track.

B2. The exercise device of section B1, wherein the base is planar.

B3. The exercise device of section B1 or B2, wherein the transition zone is a lower transition zone, and the step path further includes an upper transition zone between the return zone and the support zone.

B4. The exercise device of section B3, wherein each movable step of the plurality of movable steps further include a runner positioned on a bottom of the platform, and further comprising a positioning wheel located at the upper transition zone, the positioning wheel contacting the runner when a movable step of the plurality of movable steps is in the transition zone.

B5. The exercise device of any of sections B1-B4, further comprising a positioning element located in the transition zone.

B6. The exercise device of sections B5, wherein the first positioning element is positioned at the first transition.

B7. The exercise device of any of sections B1-B6, further comprising a positioning element located in the transition zone.

B8. The exercise device of section B7, wherein the positioning element is located between the rear guide track and the base guide track.

B9. The exercise device of section B7 or B8, wherein the first positioning element is configured to maintain the base substantially horizontal.

B10. The exercise device of any of sections B7-B9, wherein the positioning element is rotationally coupled to the drive mechanism.

B11. The exercise device of any of sections B7-B10, wherein the first positioning element rotates independent of the drive mechanism.

B12. The exercise device of any of sections B7-B11, wherein the positioning element is a first positioning element and further comprising a second positioning element.

B13. The exercise device of section B12, wherein the second positioning element is positioned in the transition zone opposite the first positioning element.

B14. The exercise device of section B12 or B13, wherein the second positioning element maintains an operating surface of the platform approximately perpendicular to a force of gravity through the transition zone.

B15. The exercise device of any of sections B12-B14, wherein the first positioning element is rotationally coupled to the second positioning element.

B16. The exercise device of any of sections B12-B15, wherein the first positioning element rotates independently from the second positioning element.

B17. The exercise device of any of sections B12-B16, wherein the first positioning element and the second positioning element rotate independent of the drive mechanism.

B18. The exercise device of any of sections B1-B17, wherein the front guide track is parallel to the rear guide track.

B19. The exercise device of any of sections B1-B18, wherein the front guide track is spaced apart from the rear guide track to maintain an operating surface of the platform perpendicular to a force of gravity when the platform is in the is in the support zone.

B20. The exercise device of any of sections B1-B19, wherein each of the plurality of movable steps are connected to the drive mechanism at a front first axis of rotation of the front set of wheels.

B21. The exercise device of any of sections B1-B20, wherein the drive mechanism includes a drive element rotatable through the step path.

B22. The exercise device of section B21, wherein the drive element includes a chain.

B23. The exercise device of section B21 or B22, wherein the drive element includes a belt.

B24. The exercise device of any of sections B21-B23, wherein the front set of wheels includes a front axle, and wherein the front axle is connected to the drive element.

B25. The exercise device of section B24, wherein the rear set of wheels are not connected to the drive element.

B26. The exercise device of section B24 or B25, further comprising a positioning element located between the rear guide track and the base guide track in the transition zone, and wherein the positioning element supports the rear set of wheels in the transition zone between the rear guide track and the base guide track.

B27. The exercise device of any of sections B24-B26, wherein, in the transition zone, the rear set of wheels are not in contact with the rear guide track or the base guide track.

B28. The exercise device of any of sections B21-B27, wherein the drive element is a first drive element and the drive mechanism includes a second drive element.

B29. The exercise device of section B28, wherein the first drive element is connected to each of the plurality of movable steps on a first side of the platform and the second drive element is connected to each of the plurality of movable steps on a second side of the platform, the second side of the platform being opposite the platform from the first side.

B30. The exercise device of section B28 or B29, wherein the second drive element is rotationally coupled to the first drive element.

B31. The exercise device of any of sections B28-B30, wherein the first drive element is not rotationally coupled to the second drive element.

B32. The exercise device of any of sections B1-B31, wherein the plurality of movable steps are configured to support the weight of a user.

B33. The exercise device of any of sections B1-B32, wherein, at a lowest point along the step path, the platform is positioned 60 mm above a supporting surface.

B34. The exercise device of section B33, wherein the lowest point is located where the second set of wheels engage the third guide track.

B35. The exercise device of section B33 or B34, wherein the drive mechanism is coupled to a braking mechanism.

B36. The exercise device of section B35, wherein the braking mechanism includes at least one of a flywheel, a friction brake, or an electromagnetic brake.

B37. The exercise device of any of sections B1-B36, wherein the plurality of movable steps comprises at least three movable steps.

B38. The exercise device of any of sections B1-B37, where the first portion of the step path comprises at least three movable steps of the plurality of movable steps.

B39. The exercise device of any of sections B1-B38, further comprising a protective enclosure, wherein the protective enclosure is configured to enclose the front set of wheels, the rear set of wheels, the front guide track, the rear guide track, the base guide track, and the drive mechanism.

B40. The exercise device of section B39, wherein at least a portion of the protective enclosure is positioned between the platform and the front set of wheels and the rear set of wheels.

C1. A method, comprising:

rotating a drive element coupled to a movable step through a step path, the step path including a support zone, a return zone, and a transition zone between the support zone and the return zone;

moving the movable step through the support zone, a front set of wheels connected to a front end of the movable step being supported by a front guide track and a rear set of wheels connected to a rear end of the movable step being supported by a rear guide track;

at the transition zone, guiding the rear set of wheels from the rear guide track to the base guide track using a positioning element; and moving the movable step through the transition zone to the return zone, wherein the rear set of wheels are supported by the base guide track in the transition zone.

C2. The method of section C1, wherein moving the movable step through the support zone includes maintaining a platform of the movable step in a substantially horizontal position.

C3. The method of section C1 or C2, wherein guiding the rear set of wheels includes maintaining a platform of the movable step in a substantially horizontal position through the transition zone.

C4. The method of any of sections C1-C3, further comprising moving the drive element based on a weight of a user applied to the movable step.

C5. The method of section C4, further comprising applying a braking force to the drive element using a braking mechanism.

C6. The method of any of sections C1C5, wherein guiding the rear set of wheels is independent of a timing of the drive element.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A movable step comprising:

a platform;

a drive mechanism movable along a step path, the step path having a support zone, a transition zone, and a return zone, the platform being connected to the drive mechanism and movable along the step path;

a front wheel connected to a front side of the platform, the front wheel being supported by a first guide track when the platform is in the support zone; and a rear wheel connected to a rear side of the platform, the rear wheel being supported by a second guide track when the platform is in the support zone, the rear wheel being supported by a third guide track when the platform is in the transition zone.

2. The movable step of claim 1, wherein the third guide track is separate from the second guide track.

3. The movable step of claim 2, wherein there is no continuous path between the second guide track and the third guide track.

4. The movable step of claim 1, wherein the front wheel includes a first front wheel and a second front wheel, the first front wheel being separated from the second front wheel with a first distance, and wherein the rear wheel includes a first rear wheel and a second rear wheel, the first rear wheel and the second rear wheel being separated by a second distance different from the first distance.

5. The movable step of claim 1, wherein the first guide track and the second guide track are parallel.

6. The movable step of claim 1, wherein the drive mechanism includes:

a first drive element connected to the platform on a first side of the platform; and a second drive element connected to the platform on a second side of the platform opposite the first side.

7. An exercise device, comprising:

a plurality of movable steps, each movable step of the plurality of movable steps including:

a platform;

a front set of wheels connected to a front side of the platform;

a rear set of wheels connected to a rear side of the platform;

a front guide track;

a rear guide track;

a base guide track, the base guide track being disconnected from the rear guide track; and a drive mechanism connected to each movable step of the plurality of movable steps, the drive mechanism moving the plurality of movable steps in a step path, wherein the step path includes a support zone, a return zone, and a transition zone between the support zone and the return zone, and wherein, in the support zone, the front set of wheels roll along the front guide track and the rear set of wheels roll along the rear guide track, and wherein, in the transition zone, the rear set of wheels roll along the base guide track.

8. The exercise device of claim 7, further comprising a positioning element located in the transition zone.

9. The exercise device of claim 8, wherein the positioning element is located between the rear guide track and the base guide track.

10. The exercise device of claim 8, wherein the positioning element is configured to maintain the platform substantially horizontal.

11. The exercise device of claim 8, wherein the positioning element is rotationally coupled to the drive mechanism.

12. The exercise device of claim 8, wherein the positioning element is a first positioning element and further comprising a second positioning element opposite the first positioning element across the platform.

13. The exercise device of claim 7, wherein the transition zone is a lower transition zone, and the step path further includes an upper transition zone between the return zone and the support zone.

14. The exercise device of claim 13, wherein each movable step of the plurality of movable steps further include a runner positioned on a bottom of the platform, and further comprising a positioning wheel located at the upper transition zone, the positioning wheel contacting the runner when a movable step of the plurality of movable steps is in the transition zone.

15. The exercise device of claim 7, wherein the front guide track is spaced apart from the rear guide track to maintain an operating surface of the platform perpendicular to a force of gravity when the platform is in the support zone.

16. The exercise device of claim 7, wherein each of the plurality of movable steps are connected to the drive mechanism at a front first axis of rotation of the front set of wheels.

17. The exercise device of claim 7, wherein, at a lowest point along the step path, the platform is positioned between 40 mm and 80 mm above a supporting surface.

18. A method, comprising:

rotating a drive element coupled to a movable step through a step path, the step path including a support zone, a return zone, and a transition zone between the support zone and the return zone;

moving the movable step through the support zone, a front set of wheels connected to a front end of the movable step being supported by a front guide track and a rear set of wheels connected to a rear end of the movable step being supported by a rear guide track;

at the transition zone, guiding the rear set of wheels from the rear guide track to a base guide track using a positioning element; and moving the movable step through the transition zone to the return zone, wherein the rear set of wheels are supported by the base guide track in the transition zone.

19. The method of claim 18, wherein moving the movable step through the support zone includes maintaining a platform of the movable step in an operating orientation through the support zone.

20. The method of claim 18, wherein guiding the rear set of wheels includes maintaining a platform of the movable step in an operating orientation through the transition zone.

* * * * *